US008571451B2

(12) United States Patent
Teshima et al.

(10) Patent No.: US 8,571,451 B2
(45) Date of Patent: Oct. 29, 2013

(54) IMAGE FORMING APPARATUS CALCULATING AN AMOUNT OF DEVIATION OF AN IMAGE FORMING POSITION FROM A REFERENCE

(75) Inventors: Eiichiro Teshima, Ashigarakami-gun (JP); Seiji Yokoyama, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 379 days.

(21) Appl. No.: 13/020,092

(22) Filed: Feb. 3, 2011

(65) Prior Publication Data

US 2011/0193922 A1 Aug. 11, 2011

(30) Foreign Application Priority Data

Feb. 8, 2010 (WO) ..... PCT/JP2010/051825

(51) Int. Cl.
*G03G 15/01* (2006.01)

(52) U.S. Cl.
USPC ..... 399/301; 347/116

(58) Field of Classification Search
USPC ..... 399/49, 72, 301; 347/116
See application file for complete search history.

(56) References Cited

U.S. PATENT DOCUMENTS 6,418,295 B1 * 7/2002 Sato ..... 399/301
8,170,430 B2 * 5/2012 Nagatsuka ..... 399/301
2009/0147286 A1 6/2009 Yano

FOREIGN PATENT DOCUMENTS

JP 2007-086439 A 4/2007
JP 2009-139709 A 6/2009

* cited by examiner

*Primary Examiner* — William J Royer
(74) *Attorney, Agent, or Firm* — Canon USA Inc. IP Division

(57) ABSTRACT

An image forming apparatus is capable of more accurately detecting the relationship between an actual amount of color deviation and an estimated amount of color deviation. The image forming apparatus forms a color deviation detection mark at timing when the estimated amount of deviation reaches a threshold value. The timing is different from the timing when it is determined that it is necessary to perform normal calibration. The image forming apparatus determines the relationship between the actual amount of deviation of an image forming position from a reference and the estimated amount of deviation to set an estimating unit for estimating the amount of deviation.

18 Claims, 16 Drawing Sheets

FIG. 3

| STATION (s) | PARAMETER | OPERATION MODE (m) | | | | | |
|---|---|---|---|---|---|---|---|
| | | 1: STANDBY | 2: SLEEP | 3: COOLING | 4: PRINT 1 | 5: PRINT 2 | ... |
| Y | a1 | | | | | | |
| | a2 | | | | | | |
| | b1 | | | | | | |
| | b2 | | | | | | |
| M | a1 | | | | | | |
| | a2 | | | | | | |
| | b1 | | | | | | |
| | b2 | | | | | | |
| C | a1 | | | | | | |
| | a2 | | | | | | |
| | b1 | | | | | | |
| | b2 | | | | | | |
| K | a1 | | | | | | |
| | a2 | | | | | | |
| | b1 | | | | | | |
| | b2 | | | | | | |

A

B

C

* a1, a2, b1, AND b2 DENOTE CONSTANT PARAMETERS OF ALGORITHM FUNCTION F[s,m](t)

IMAGE FORMING APPARATUS CALCULATING AN AMOUNT OF DEVIATION OF AN IMAGE FORMING POSITION FROM A REFERENCE

FIELD OF THE INVENTION

The present invention generally relates to an image forming apparatus and, more particularly, to a mechanism for correcting shift in laser light irradiation position in an image forming apparatus.

DESCRIPTION OF THE RELATED ART

In image forming apparatuses that form color images by superposing toner images of multiple colors, no occurrence of color deviation is valued in order to ensure the quality of the product. The color deviation is typically caused by variation in laser light irradiation position on photosensitive drums, occurring with thermal deformation of optical units. Such color deviation can be reliably corrected by a calibration method with formation of a color deviation detection mark. However, it is not desirable to frequently perform the calibration in consideration of the time required to perform the calibration and the consumption of the toner.

In the above situation, a method of measuring a variation in temperature in an image forming apparatus and estimating the variation in laser light irradiation position (image forming position) to correct the color deviation without performing the calibration is disclosed in, for example, Japanese Patent Laid-Open No. 2007-086439. Japanese Patent Laid-Open No. 2007-086439 discloses a technology to set a calculation coefficient used in estimation of the amount of color deviation in accordance with the amount of color deviation that is actually measured by forming the color deviation detection mark. According to Japanese Patent Laid-Open No. 2007-086439, it is possible to further improve the accuracy in the estimation of the color deviation.

As a background to the above, the mode in which the color deviation occurs is complicated because of, for example, the complication of the internal structure of the image forming apparatus with further decreased size of the image forming apparatus. For example, Japanese Patent Laid-Open No. 2009-139709 indicates a case in which there is no one-to-one correspondence between the direction in which the temperature is varied (increased or decreased) and the direction of the color deviation. Examples of such a case are illustrated in FIG. 16A. Referring to FIG. 16A, the vertical axis represents the relative amount of deviation of magenta with respect to yellow and the horizontal axis represents time. Also in an image forming apparatus exhibiting the color deviation behavior illustrated in FIG. 16A, it is desirable to correct the calculation to estimate the color deviation by using the difference between the estimated amount of color deviation and the amount of color deviation that is actually measured, as in Japanese Patent Laid-Open No. 2007-086439.

However, the following problems occur in the image forming apparatus exhibiting the color deviation behavior illustrated in FIG. 16A. For example, the amount of color deviation that actually occurs can be close to zero in the measurement of the amount of color deviation by using the variation in environment information (for example, temperature or humidity) in the image forming apparatus, which exceeds a predetermined value, as a trigger. FIG. 16B illustrates an example of the above state. In this case, the signal-to-noise (S/N) ratio is decreased and, thus, it is difficult to accurately determine the relationship between the actual amount of color deviation and the estimated amount of color deviation. As a result, it is difficult to improve the estimation accuracy of the amount of color deviation based on the actual amount of color deviation.

In order to resolve the above problems, the present invention attempts to more accurately determine the relationship between an actual amount of deviation of an image forming position from a reference and an estimated amount of deviation to facilitate the improvement in the estimation accuracy of the amount of deviation.

SUMMARY OF INVENTION

The present invention provides an image forming apparatus calculating an amount of deviation of an image forming position from a reference, the amount of deviation being caused by thermal effect in the apparatus. The image forming apparatus includes an estimating unit for estimating the amount of deviation with time; a mark forming unit for forming a color deviation detection mark; a detecting unit for detecting reflected light upon irradiation of the formed color deviation detection mark with light; a control unit for causing the mark forming unit to form the color deviation detection mark and causing the detecting unit to perform the detection at timing when the amount of deviation estimated by the estimating unit is estimated to reach a threshold value; and a setting unit for setting the estimating unit so that an amount of deviation that is estimated becomes close to the amount of deviation that actually occurs based on the amount of deviation detected at the timing and the amount of deviation estimated by the estimating unit. The control unit causes the mark forming unit to form the color deviation detection mark and causes the detecting unit to perform the detection at another timing different from the timing when the amount of deviation reaches the threshold value again after the setting by the setting unit is performed.

Further features of the present invention will become apparent from the following description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 3 is a diagram for describing an image of a parameter table used for an algorithm function.

DESCRIPTION OF THE EMBODIMENTS

Exemplary embodiments of the present invention will be described below with reference to the attached drawings. However, the components described in the embodiments are only examples and the scope of the present invention is not intended to be limited to the exemplary embodiments.

First Embodiment

A first embodiment of the present invention will now be described with reference to FIGS. 1A to 10B.

<Cross-Sectional View of Printer>

Figure 1A:
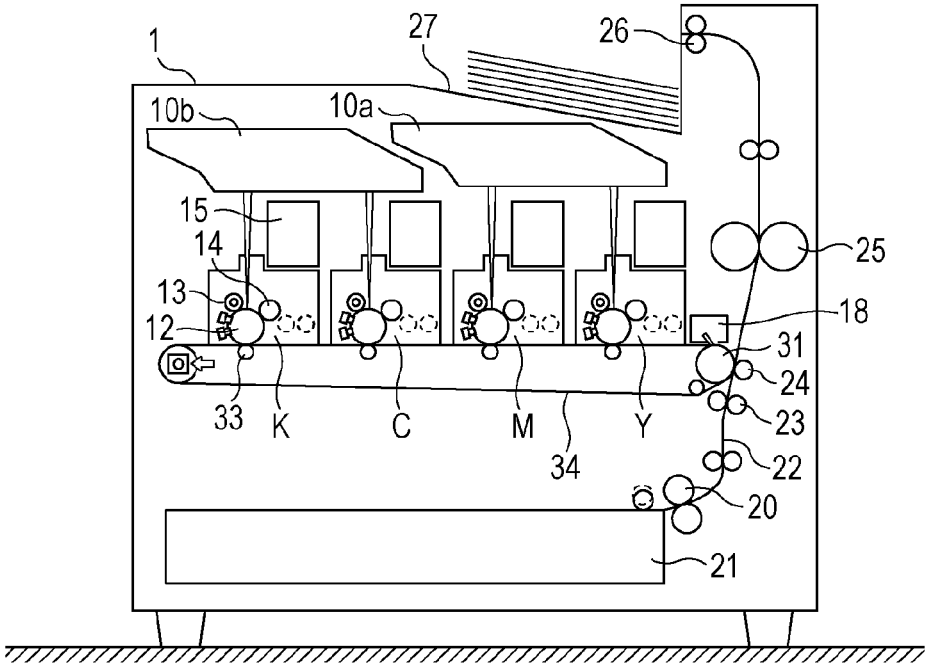
FIG. 1A is a schematic cross-sectional view of an image forming apparatus and FIG. 1B is a schematic cross-sectional view of an optical unit.
Figure 1B:
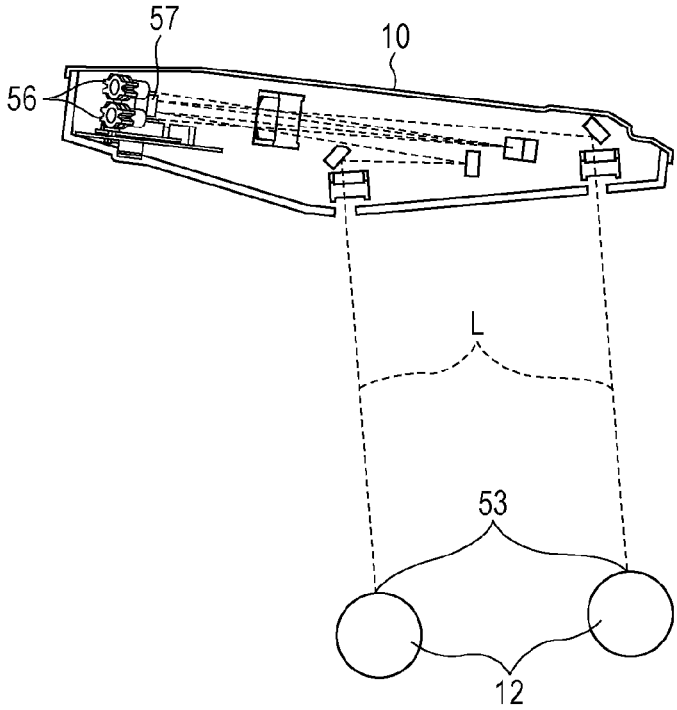

FIGS. 1A and 1B include schematic cross-sectional views of a color image forming apparatus to which the present invention is applied. Reference numeral 1 denotes the main body of a printer (hereinafter referred to as a printer body). So-called engine portions that form primary images of four colors: yellow, magenta, cyan, and black (hereinafter abbreviated to Y, M, C, and K) are arranged at an upper part of the printer body 1.

Print data transmitted from an external apparatus, such as a personal computer (PC), is received by a video controller that controls the printer body 1 and is supplied to laser scanners (optical units in related art) 10 corresponding to the respective colors as written image data. The laser scanners 10 irradiate photosensitive drums 12 for each of the four colors Y, M, C, and K with laser light to draw optical images corresponding to the written image data. In the image forming apparatus of the present embodiment, two laser scanners including a first laser scanner 10*a* that irradiates the photosensitive drums 12 for the Y and M colors with laser light and a second laser scanner 10*b* that irradiates the photosensitive drums 12 for the C and K colors with laser light are used to draw the optical images. The first laser scanner 10*a* and the second laser scanner 10*b* adopt a structure in which one polygon mirror 57 is used to scan the laser light for two stations. Specifically, each of the laser scanners 10 in the present embodiment adopts a structure illustrated in a schematic cross-sectional view in FIG. 1B.

The laser scanners 10 each generally adopts a structure in which the laser light emitted from a light source 56 (an optical element) is reflected by the polygon mirror 57 that is rotating to perform the scanning. The laser light is reflected by mirrors several times to be changed in the traveling direction and the spot and/or the scanning width of the laser light is adjusted via lenses during a period in which the laser light emitted from the light source 56 reaches the photosensitive drum 12. These mechanical components defining an optical path L of the laser light are fixed on a frame forming the laser scanners 10. If the frame is subjected to thermal deformation due to an increase in temperature caused by the operation of the image forming apparatus, the orientations of these components are also changed to affect the direction of the optical path L of the laser light. Since the change in the direction of the optical path L is amplified in proportion to the length of the optical path L to the photosensitive drum 12, the change in the direction of the optical path L appears as a variation in laser light irradiation position 53 (image forming position) even if the frame of the laser scanners 10 is subjected to minute deformation. The variation in the laser light irradiation position 53 caused by the increase in temperature is called thermal shift in the laser light irradiation position 53.

The engine portion in each of the stations for Y, M, C, and K includes a toner cartridge 15 that supplies toner and a process cartridge 11 (Fiq. 2) that forms a primary image. The process cartridge 11 includes the photosensitive drum 12 serving as a photoconductor and a charger 13 by which the surface of the photosensitive drum 12 is uniformly charged. The process cartridge 11 also includes a developing unit 14 that develops an electrostatic latent image formed by each of the laser scanners 10 (the first laser scanner 10a and the second laser scanner 10b) that draws an optical image on the surface of the photosensitive drum 12 charged by the charger 13 to form a toner image to be transferred to an intermediate transfer belt 34. The process cartridge 11 further includes a cleaner (not shown) for removing the toner remaining on the photosensitive drum 12 after the transfer of the toner image. A primary transfer roller 33 for transferring the toner image formed on the surface of the photosensitive drum 12 to the intermediate transfer belt 34 is arranged at a position opposite the photosensitive drum 12.

The toner image (primary image) transferred to the intermediate transfer belt 34 is retransferred to a sheet of paper by a secondary transfer roller 31 also serving as a driving roller for the intermediate transfer belt 34 and a secondary transfer outer roller 24 opposite the secondary transfer roller 31. The toner that is not transferred to the sheet of paper by the secondary transfer unit and remains on the intermediate transfer belt 34 is recovered by an intermediate transfer belt cleaner 18.

A paper feed unit 20 is arranged at an uppermost position in a sheet conveying path and is provided at a lower part of the apparatus. Each sheet of paper loaded in a paper feed tray 21 is fed by the paper feed unit 20 and passes through a vertical conveying path 22 to be conveyed toward a downstream side. A registration roller pair 23 is provided on the vertical conveying path 22. Final correction of skew of the sheet of paper and matching in timing between the image writing in the image forming unit and the sheet conveyance are performed at the registration roller pair 23.

A fixing unit 25 that fixes the toner image on the sheet of paper as a permanent image is provided at a downstream side of the image forming unit. At a downstream side of the fixing unit 25, the sheet conveying path branches into a discharge conveying path toward a discharge roller 26 that discharges the sheet of paper from the printer body 1 and a conveying path toward a reversing roller (not shown) and a duplex conveying path (not shown). The sheet of paper discharged by the discharge roller 26 is received by a paper output tray 27 provided outside the printer body 1.

<Typical Hardware Configuration of Printer>

A typical hardware configuration of a printer will now be described with reference to FIG. 2.

<Video Controller 200>

A video controller 200 will be first described. Reference numeral 204 denotes a central processing unit (CPU) that controls the entire video controller 200. Reference numeral 205 denotes a non-volatile storage device in which a variety of control code executed by the CPU 204 is stored. The non-volatile storage device 205 corresponds to, for example, a read only memory (ROM), an electrically erasable programmable read only memory (EEPROM), or a hard disk. Reference numeral 206 denotes a random access memory (RAM) for temporary storage, which functions as a main memory, a working area, and the like of the CPU 204.

Reference numeral 207 denotes a host interface (denoted by a host I/F in FIG. 2), which is an input-output unit through which print data and control data are transmitted to and received from an external apparatus, such as a host computer 100. The printout data received through the host interface 207 is stored in the RAM 206 as compressed data. Reference numeral 208 denotes a data decompressor that decompresses the compressed data. The data decompressor 208 decompresses arbitrary compressed data stored in the RAM 206 into image data in units of lines. The decompressed image data is stored in the RAM 206.

Reference numeral 209 denotes a Direct Memory Access (DMA) controller. The DMA controller 209 transfers the image data in the RAM 206 to an engine interface 211 (denoted by an engine I/F in FIG. 2) in response to an instruction from the CPU 204. Reference numeral 210 denotes a panel interface (denoted by a panel I/F in FIG. 2) that receives various settings and instructions from an operator from a panel unit provided in the printer body 1. The engine interface 211 (denoted by an engine I/F in FIG. 2) is an input-output unit through which a signal is transmitted to and received from a printer engine 300. A data signal is transmitted from an output buffer register (not shown) through the engine interface 211. The engine interface 211 controls communication with the printer engine 300. Reference numeral 212 denotes a system bus including an address bus and a data bus. The above components are connected to the system bus 212, which enables access between the components.

<Printer Engine 300>

Next, the printer engine 300 will be described. The printer engine 300 is mainly composed of an engine control unit and an engine mechanism unit. The engine mechanism unit operates in response to various instructions from the engine control unit. The engine mechanism unit will be first described and, then, the engine control unit will be described.

A laser scanner system 331 includes a laser-light emitting element, a laser driver circuit, a scanner motor, a polygon mirror, a scanner driver, and the like. The laser scanner system 331 exhibits and scans the photosensitive drum 12 with laser light in accordance with image data transmitted from the video controller 200 to form a latent image on the photosensitive drum 12.

An imaging system 332 is a central part of the image forming apparatus. The imaging system 332 forms a toner image based on the latent image formed on the photosensitive drum 12 on a sheet of paper. The imaging system 332 includes process elements, such as a process cartridge 11, the intermediate transfer belt 34, and the fixing unit 25, and a high-voltage power supply circuit that produces various biases (high voltage) for the imaging.

The process cartridge 11 includes an eliminator, the charger 13, the developing unit 14, the photosensitive drum 12, and the like. The process cartridge 11 is provided with a non-volatile memory tag. A CPU 321 or an Application Specific Integrated Circuit (ASIC) 322 reads or writes a variety of information from or into the memory tag.

A paper feed-conveying system 333 performs feed and conveyance of sheets of paper. The paper feed-conveying system 333 includes various conveying system motors, the paper feed tray 21, the paper output tray 27, various conveying rollers (for example, the discharge roller 26), and the like.

A sensor system 334 is a sensor group that collects information necessary for the CPU 321 and the ASIC 322 described below to control the laser scanner system 331, the imaging system 332, and the paper feed-conveying system 333. The sensor group includes at least various known sensors including a temperature sensor for the fixing unit 25 and a density sensor that detects the density of images. Although the sensor system 334 in FIG. 2 is separated from the laser scanner system 331, the imaging system 332, and the paper feed-conveying system 333, the sensor system 334 may be included in any of the systems.

Next, the engine control unit will be described. The CPU 321 uses a RAM 323 as a main memory and a working area and controls the engine mechanism unit described above in accordance with various control programs stored in a non-volatile storage device 324. Specifically, the CPU 321 drives the laser scanner system 331 on the basis of a print control command and image data supplied from the video controller 200 through the engine interface 211 and an engine I/F 325. The CPU 321 controls the imaging system 332 and the paper feed-conveying system 333 to control various print sequences. In addition, the CPU 321 drives the sensor system 334 to acquire information necessary for controlling the imaging system 332 and the paper feed-conveying system 333.

The ASIC 322 controls each motor and the high-voltage power supply producing, for example, a developing bias to execute the various print sequences described above in response to an instruction from the CPU 321. Reference numeral 326 denotes a system bus including an address bus and a data bus. The components in the engine control unit are connected to the system bus 326, which enables access between the components. Part or all of the functions of the CPU 321 may be performed by the ASIC 322 or part or all of the functions of the ASIC 322 may be performed by the CPU 321. Part of the functions of the CPU 321 and/or the ASIC 322 may be performed by dedicated hardware provided separately from the CPU 321 and the ASIC 322.

<How Color Deviation Occurs>

As described above with reference to FIGS. 1A and 1B, the image forming apparatus of the present embodiment adopts the laser scanners 10 each configured so as to scan the laser light for two stations with one polygon mirror 57. Specifically, the image forming apparatus of the present embodiment includes the two laser scanners 10: the first laser scanner 10*a* for yellow and magenta and the second laser scanner 10*b* for cyan and black. If a change in temperature occurs in the apparatus, the laser scanner 10 is subjected to minute thermal deformation. The laser light irradiation position 53 on the surface of the photosensitive drum 12 is moved in the secondary scanning direction (the sheet conveying direction) due to the minute thermal deformation of the laser scanner 10. Since the two laser light beams from each of the laser scanners 10 pass through the optical elements having different configurations on the optical path L from the light source 56 to the surface of the photosensitive drum 12 in the configuration of the present embodiment, the laser light beams have different characteristics of the variation in the laser light irradiation position 53. In addition, since the first laser scanner 10*a* differs from the second laser scanner 10*b* in the condition of a heat source surrounding the laser scanner 10 despite the fact that the same laser scanner 10 is used for the first laser scanner 10*a* and the second laser scanner 10*b*, it is difficult to estimate the correlation between the variation, an increase or a decrease, in the laser light irradiation position 53 and an increase or a decrease in temperature. Furthermore, different colors have different characteristics of the variation in the laser light irradiation position 53. As a result, relative color deviation between the respective colors of Y, M, C, and K occurs with an increase in the temperature of the apparatus. With the image forming apparatus of the present embodiment, it is possible to perform the calibration at appropriate timing, to realize superior image quality, and to suppress the consumption of consumable parts. This will be described below.

<Calculation to Estimate Laser Light Irradiation Position (Estimation of Image Forming Position)>

In the image forming apparatus of the present embodiment, the engine control unit has a function of estimating the amount of deviation of the laser light irradiation position with time by, for example, calculation and adjusting the laser light irradiation position of each color on the basis of the estimated amount of deviation to correct the color deviation. The amount of deviation in the present embodiment means a shift in the image forming position of a certain color from a certain reference (position) and various values can be set as the reference. For example, various modes including a position different from the image forming positions of the respective colors: Y, M, C, and K, the image forming position of Y, and the state of a certain color at certain timing can be applied to the reference. The relative amount of deviation of C, M and K with respect to the image forming position of Y will hereinafter be described. However, a position different from the image forming positions of Y, M, C, and K may be set as the reference and the amount of deviation from the reference may be applied. In this case, for example, a mark provided at an end of a belt may be applied as the reference. As described above, similar effects can be achieved with various modes set as the reference.

The non-volatile storage device 324 serving as a parameter storage unit stores the values of constants to be applied to an arithmetic algorithm to estimate the color deviation as a parameter table. In the parameter table, the values of the constants are associated with each color and each operation mode of the image forming apparatus. The numerical value corresponding to each parameter of the arithmetic algorithm is applied in response to the current operation mode. The operation modes represent different operation states of the image forming apparatus and include a standby mode, a sleep mode, a print 1 mode in which the printing is performed, a print 2 mode in which the printing is performed, and a cooling mode. The print 1 mode means a normal print mode using plain paper and the print 2 mode means a mode, such as a cardboard mode or an overhead transparency (OHT) mode, in which the imaging is performed at a speed lower than that in the plain paper print mode.

An example of the parameter table is illustrated in FIG. 3. Referring to FIG. 3, parameters a1, a2, b1, and b2 denote constant parameters in an algorithm function; Y, M, C, and K are allocated to station (s); and the operation modes described above are allocated to operation mode (m). The roles of the parameters a1, a2, b1, and b2 will be described below.

The arithmetic algorithm that is used to estimate the amount of deviation and that is executed by the CPU 321 can calculate the estimated value of the color deviation from information about the "operation time" and the "operation mode of the image forming apparatus" necessary for determining the numerical values of the parameters. The algorithm function is represented as Expression (1):

$$F_{[s,m]}(t) \tag{1}$$

where s denotes the station, m denotes the operation mode, and t denotes the operation time since the operation mode has been switched. Information used for selecting the parameter is specified in [ ] in Expression (1) and an input variable is specified in ( ) therein.

<Detailed Description of Calculation (Algorithm)>

Figure 4A:
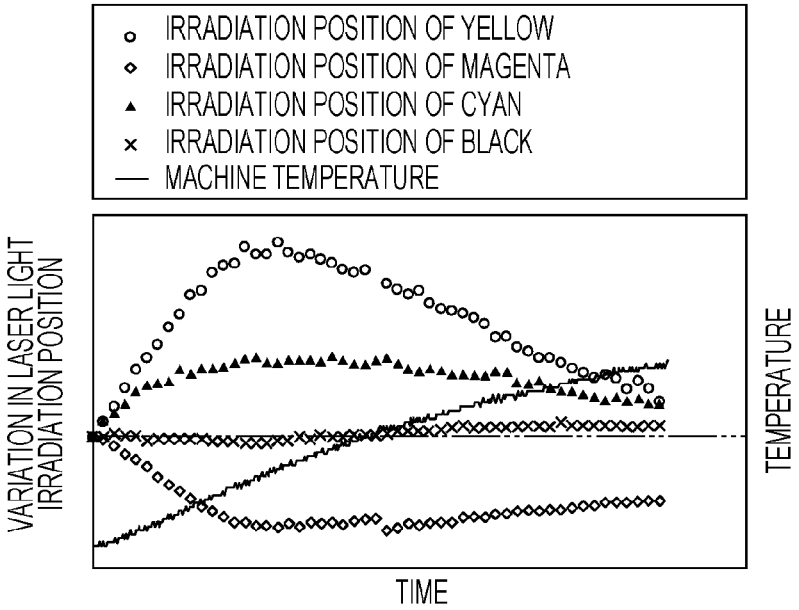
FIG. 4A is a graph illustrating a result of measurement of variation in laser light irradiation position according to a first embodiment.

The design concept and the schematic structure of the algorithm adopted in the present embodiment will now be briefly described. It is inferred that the variation in the laser light irradiation position can be represented by an algorithm based on a temperature phenomenon even if no correlation with the actual variation in temperature is found as long as the variation in the laser light irradiation position is caused by the variation in temperature. FIG. 4A illustrates a specific example of the characteristics of the variation in the laser light irradiation position of the image forming apparatus of the present embodiment. The characteristics of the variation in the laser light irradiation position of the image forming apparatus of the present embodiment illustrated in FIG. 4A can be approximately represented, assuming that the laser scanners are subjected to complicated deformation due to the relative difference in the variation in temperature between multiple points in the apparatus and the deformation of the optical units causes the variation in the laser light irradiation position.

Specifically, the algorithm function in the present embodiment is created in the following manner. The algorithm function is created with attention paid to the fact that the result of the measurement illustrated in FIG. 4A has the characteristics that are varied so as to draw S-shaped curves. It is assumed here that the variation in the laser light irradiation position is caused by the relative difference in temperature between two virtual points. The two virtual points can be specifically interpreted as thermal effects causing the color deviation. Examples of the heat source include elements, such as a polygon motor and a laser board, which generate heat with the operation of the image forming apparatus. The virtual points can also be interpreted as virtual/pseudo heat sources that comprehensively represent the effect of the multiple specific heat sources described above on a part of the laser scanner subjected to the thermal deformation causing the variation in the laser light irradiation position. For example, when the polygon motor starts to rotate, the temperature of a part near the polygon motor on the frame forming the laser scanner sharply increases and converges in a short time. In contrast, the temperature of a part away from the polygon motor gradually increases and converges in a long time. The thermal deformation of the respective parts has different effect characteristics on the laser light irradiation position. In addition, similar phenomena are observed in other specific heat sources. In short, the phenomena of the different effect characteristics on the laser light irradiation position, taking into consideration the specific heat sources, are approximated by assuming the presence of the two virtual points.

As described above, the two virtual points can be interpreted as a first thermal effect and a second thermal effect, and the variation in the laser light irradiation position is caused on the basis of the degrees of variation in temperature of the first thermal effect and the second thermal effect. A result of modeling of the variation in temperature of the two thermal effects is illustrated in FIG. 4C.

Figure 4B:
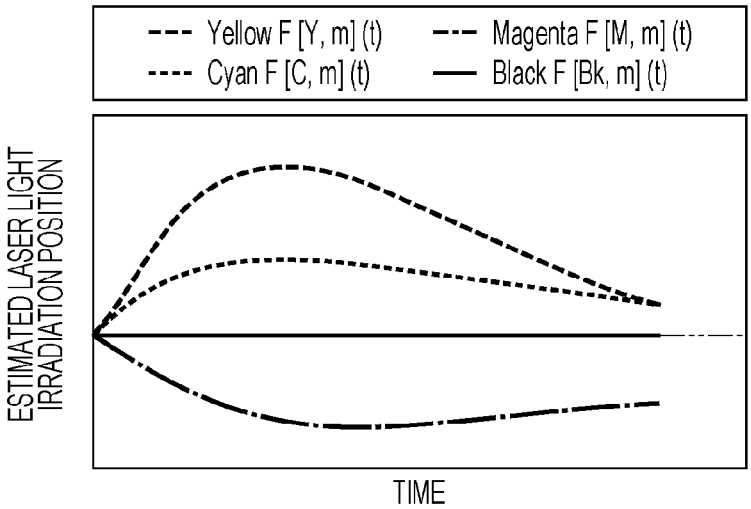
FIG. 4B is a graph illustrating a result of calculation by an estimation algorithm according to the first embodiment.
Figure 4C:
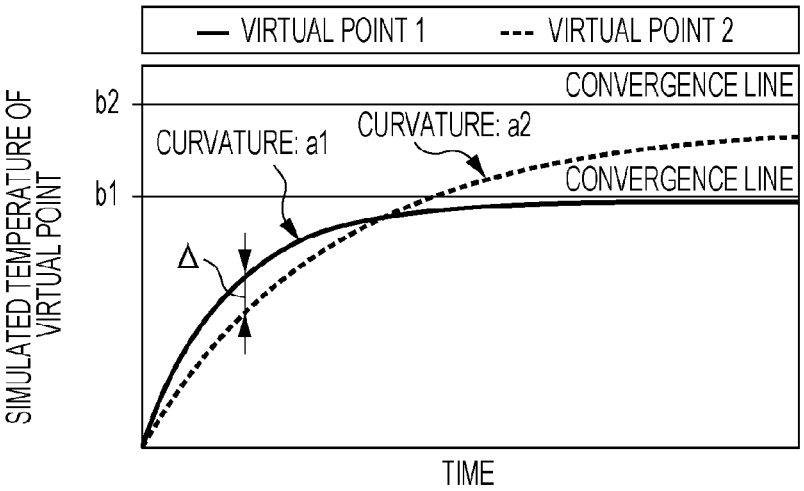
FIG. 4C is a graph illustrating the basic structure of the algorithm according to the first embodiment.

FIG. 4C illustrates specific examples of the variation in temperature of the respective virtual points (the first thermal effect and the second thermal effect) and indicates the basic structure of the algorithm. A virtual point 1 assumes the thermal effect in which the temperature sharply increases and converges in a short time, and a virtual point 2 assumes the thermal effect in which the temperature gradually increases and converges in a long time. The phenomena of the variation characteristics that converge in S-shaped curves, like the result of the measurement illustrated in FIG. 4A, can be approximated, assuming that the variation in temperature of the virtual point 1 and the variation in temperature of the virtual point 2 have the effects that vary the laser light irradiation position in opposite directions on the same graph. On the basis of the above phenomena, the above-described basic S-shaped variation characteristics are approximated by using a value resulting from multiplication of the difference in temperature (denoted by Δ in FIG. 4C) between the two virtual points by a certain coefficient as the estimated amount of the variation in the laser light irradiation position. Accordingly, in FIG. 4C, the direction of the variation in the laser light irradiation position in a case in which a curve of a curvature a1 is above a curve of a curvature a2 is opposite to that in a case in which the curve of the curvature a2 is above the curve of the curvature a1. As described above, the basic arithmetic expression of these algorithms is common to the stations and the operation modes, and the values of parameters to be adopted are appropriately selected by the non-volatile storage device 324.

As illustrated in the parameter table in FIG. 3, the constant parameters a1, a2, b1, and b2 to be switched for every station and operation mode are set in the algorithm function created in the present embodiment. Among the parameters, the parameters a1 and a2 determine the degree of variation in temperature (the curvature of the curve to be drawn) of the two virtual points simulated by using Expression (1). In contrast, the parameters b1 and b2 determine the values into which the temperatures of the virtual points should be converged when the same operation mode is continued for infinite time.

With the algorithm (arithmetic expression) described above, the S-shaped characteristics of the variation in the position (the characteristics of the variation in the amount of deviation) can be estimated for every station (color) and for every operation mode. In other words, it is possible to estimate the characteristics of the variation in the position for every operation mode, in which the amount of deviation in the laser light irradiation position gradually increases due to the effect of the heat in the apparatus, the amount of deviation of the laser light irradiation position gradually decreases with time, and the amount of deviation of the laser light irradiation position converges with time.

The estimation of the variation in the laser light irradiation position illustrated in FIG. 4A by calculation by the CPU 321 in the engine control unit of the present embodiment results in a graph in FIG. 4B. The curves indicated in this graph are drawn by plotting the result of the calculation of the above algorithm function, Expression (1), and indicate the estimated laser light irradiation positions (the estimated positions corresponding to the variation in temperature). The curves indicated in the graph are matched with the result of the measurement (FIG. 4A).

<Calculation to Estimate Amount of Color Deviation>

Figure 5A:
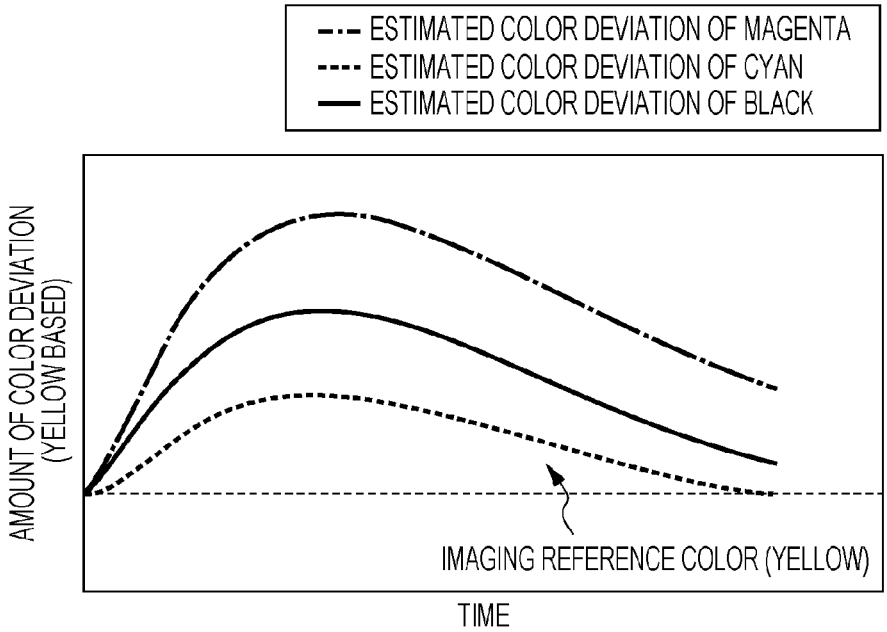
FIG. 5A is a graph resulting from conversion of a result of estimation into color deviation (yellow based) according to the first embodiment and FIG. 5B roughly indicates how to control correction based on the estimation.

The engine control unit calculates the relative amount of color deviation between an imaging reference color (yellow in the present embodiment) and another color from the result of the estimation calculated from the algorithm function to estimate the color deviation. The conversion of the result of the estimation of the variation in the laser light irradiation position illustrated in FIG. 4B into the color deviation based on yellow results in a graph in FIG. 5A. Referring to FIG. 5A, the estimated color deviation of magenta with respect to yellow, which is the basic color, is denoted by an alternate long and short dash line, the estimated color deviation of cyan with respect to yellow is denoted by a dashed line, and the estimated color deviation of black with respect to yellow is denoted by a solid line. The relative amount of color deviation of each color with respect to yellow, which is the basic color, is calculated according to the following Expression (2):

$$\text{Amount of color deviation: } F_{[Y,m]}(t)-F_{[s,m]}(t) \quad (2)$$

The amounts of color deviation of the respective colors with respect to yellow, which is the basic color, are calculated according to the following expressions:

$$\text{Magenta: } F_{[Y,m]}(t)-F_{[M,m]}(t)$$

$$\text{Cyan: } F_{[Y,m]}(t)-F_{[C,m]}(t)$$

$$\text{Black: } F_{[Y,m]}(t)-F_{[Bk,m]}(t)$$

Figure 5B:
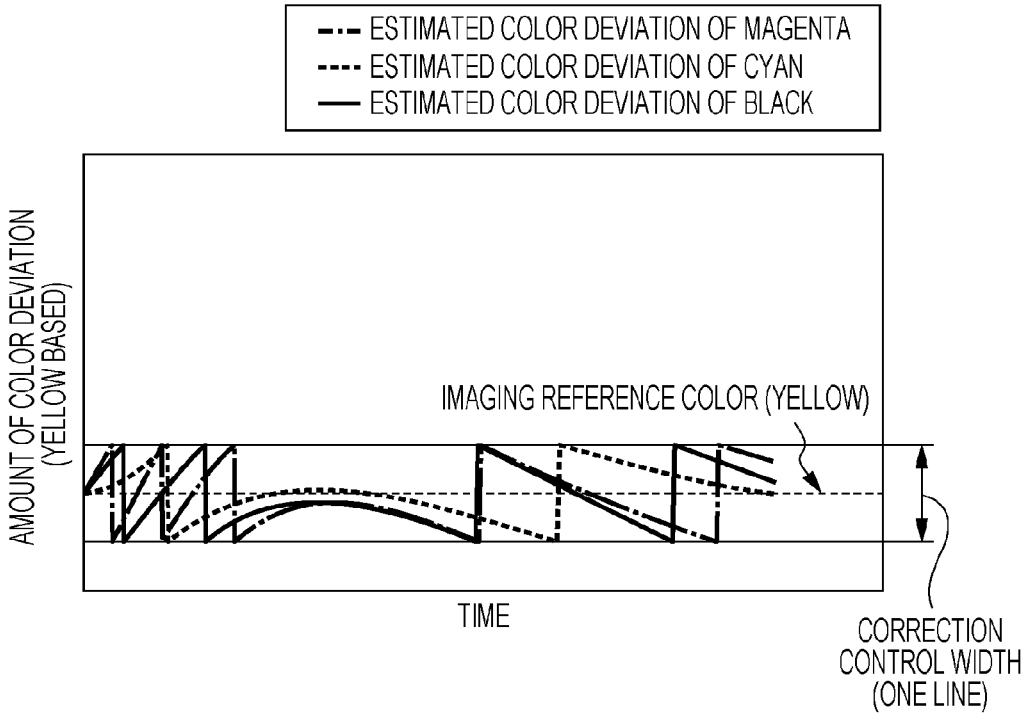

The timing of the irradiation of laser light is controlled so that the amount of color deviation becomes lower than or equal to a certain amount of deviation. In the image forming apparatus of the present embodiment, the timing of the irradiation of laser light is controlled so that the estimated position of another color with respect to the imaging reference color is within a range of ±0.5 lines, where the minimum unit in the adjustment of the laser light irradiation position is defined as one line. The result of correction in a case in which the control of the timing of the irradiation of laser light by the correction of the color deviation is applied to the variation in the color deviation illustrated in FIG. 5A is illustrated in FIG. 5B. FIG. 5B roughly indicates how to control the correction based on the estimation.

<Flowchart to Set Amount-Of-Color Deviation Estimating Unit for Correction>

A method of controlling the correction of the color deviation, adopted in the present embodiment, will now be described in detail with reference to flowcharts of control processes shown in FIG. 7 and FIG. 9. The processes in the flowcharts are performed by the engine control unit in FIG. 2.

Figure 7:
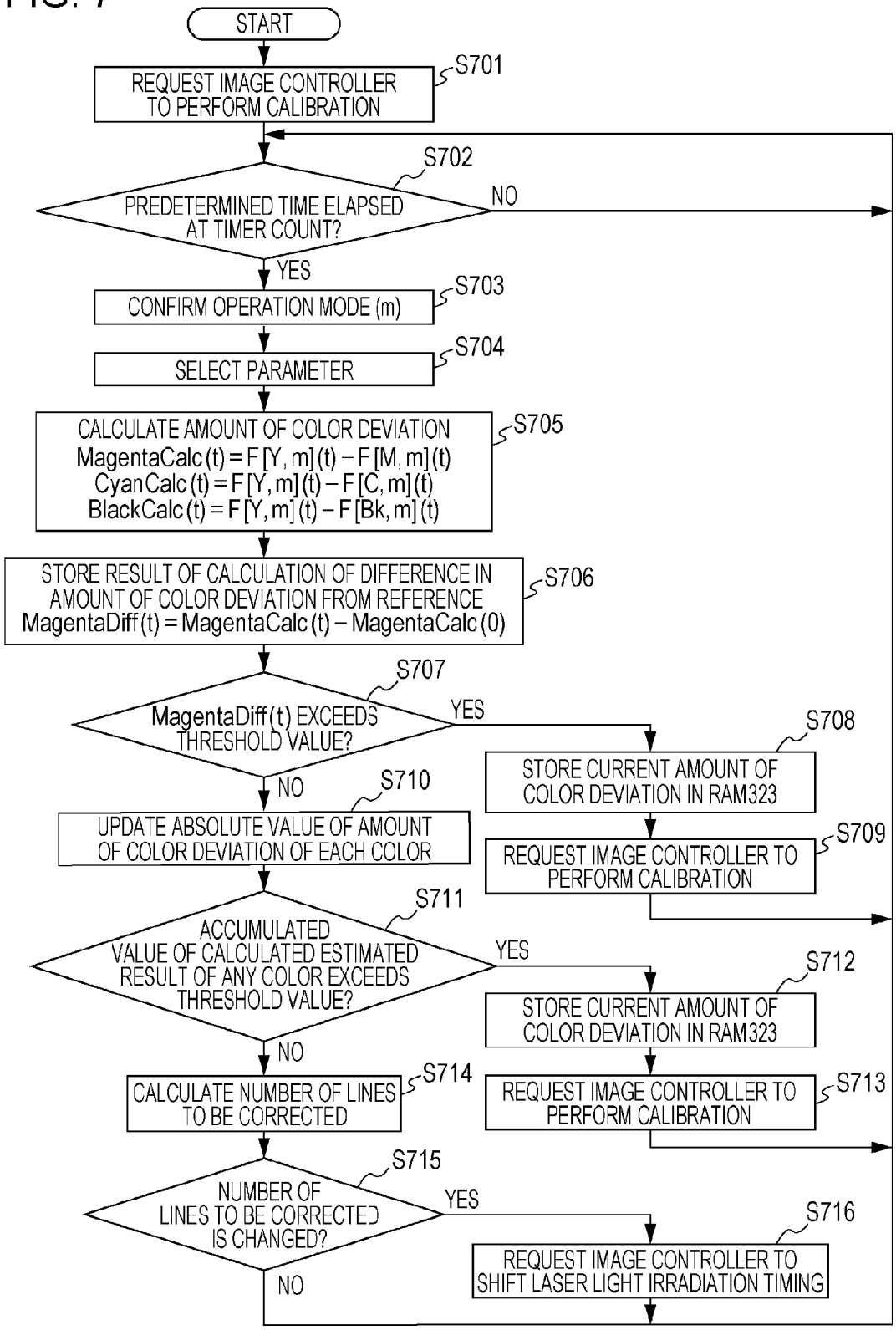
FIG. 7 is a flowchart concerning determination of timing when an amount-of-color deviation estimating unit is set for correction according to the first embodiment.
Figure 8:
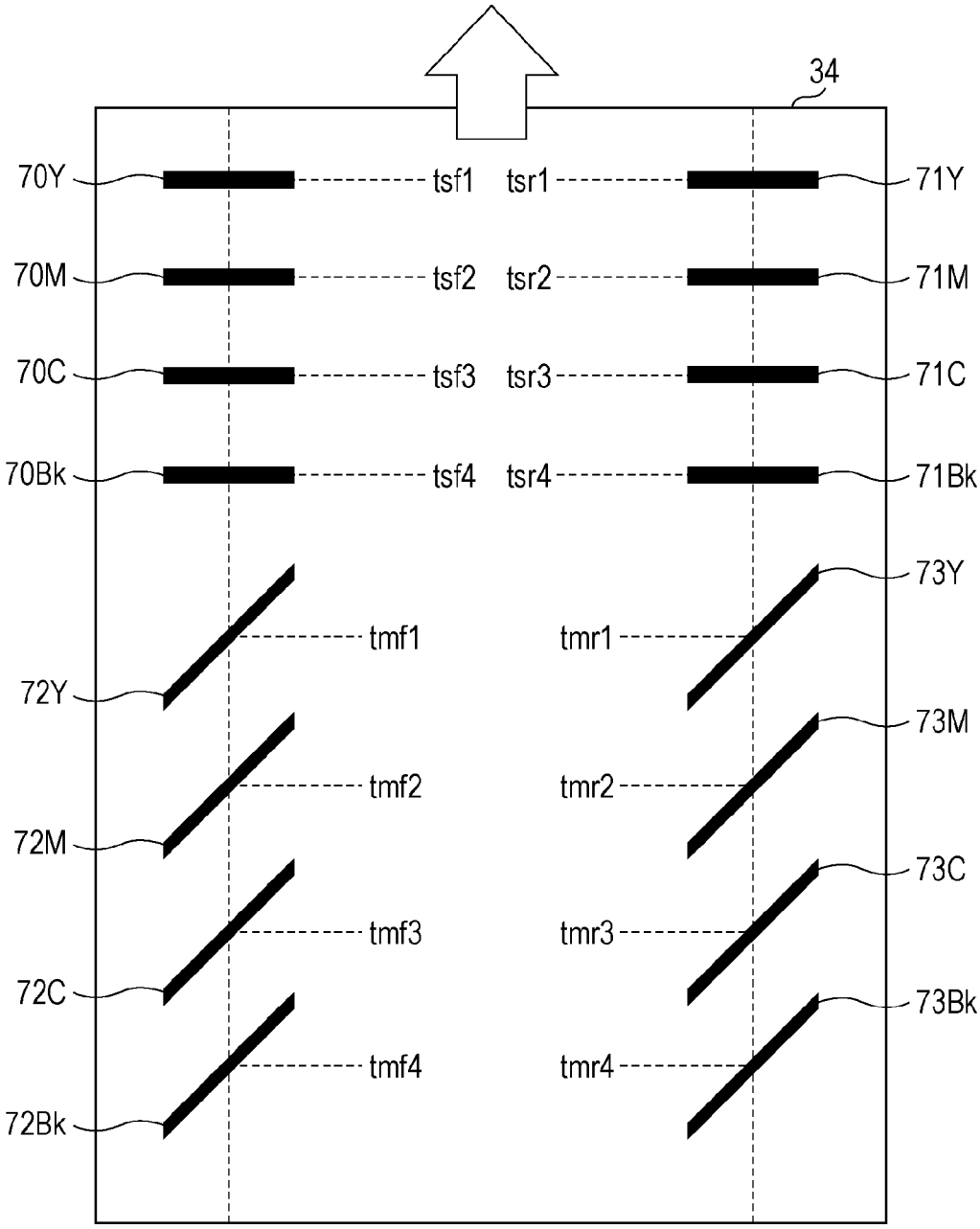
FIG. 8 illustrates an example of how color deviation detection marks are formed.

FIG. 7 is a flowchart concerning determination of the timing when amount-of-color deviation estimating unit is set for correction. Referring to FIG. 7, in Step S701, the CPU 321 instructs the image controller to perform calibration for the normal color deviation correction. The calibration means the correction of the color deviation. In the calibration, for example, a set of color deviation detection marks illustrated in FIG. 8 is formed on the intermediate transfer belt 34 by the engine mechanism unit in FIG. 2. The color deviation detection marks are irradiated with light to detect an edge of each color deviation detection mark from the light reflected from the mark. The edge indicates the timing when the color deviation detection mark is detected and the detection timing corresponds to the detection position. Step S701 is performed to reset the amount of color deviation of each color to approximately zero in calculation of the amount of color deviation in Step S705 described below and is performed, for example, when the image forming apparatus is turned on. If the reference state of the color deviation may be arbitrary, Step S701 may be skipped. Step S701 may be skipped also if the temperature in the apparatus does not increase when the apparatus is turned on because the color deviation does not substantially occur in such a case.

How the color deviation detection marks are formed is illustrated in FIG. 8. Reference numerals 70Y, 70M, 70C, 70Bk, 71Y, 71M, 71C, and 71Bk denote patterns used to detect the amount of color deviation in the sheet conveying direction (secondary scanning direction). Reference numerals 72Y, 72M,72, C, 72Bk, 73Y, 73M, 73C, and 73Bk denote patterns used to detect the amount of color deviation in the main scanning direction orthogonal to the sheet conveying direction. In the example in FIG. 8, the patterns 72 and 73 tilt by 45° with respect to the patterns 70 and 71. Reference letters and numerals tsf1 to tsf4, tmf1 to tmf4, tsr1 to tsr4, and tmr1 to tmr4 denote the detection timing of the respective patterns. An arrow denotes the traveling direction of the intermediate transfer belt 34.

An amount of positional shift δes of each color with respect to yellow in the conveying direction is calculated according to the following expressions:

$$\delta\delta sM=v*\{(tsf2-tsf1)+(tsr2-tsr1)\}/2-dsY$$

$$\delta esC=v*\{(tsf3-tsf1)+(tsr3-tsr1)\}/2-dsM$$

$$\delta esBk=v*\{(tsf4-tsf1)+(tsr4-tsr1)\}/2-dsC$$

In the above expressions, v (mm/s) denotes the traveling speed of the intermediate transfer belt 34, Y denotes a reference color, and dsY (mm), dsM (mm), and dsC (mm) denote the logical distances between the patterns for the sheet conveying direction of the respective colors and the pattern of Y.

Since the main scanning direction is a known technical term and is not directly related to the present invention, a detailed description thereof is omitted herein.

Figure 6:
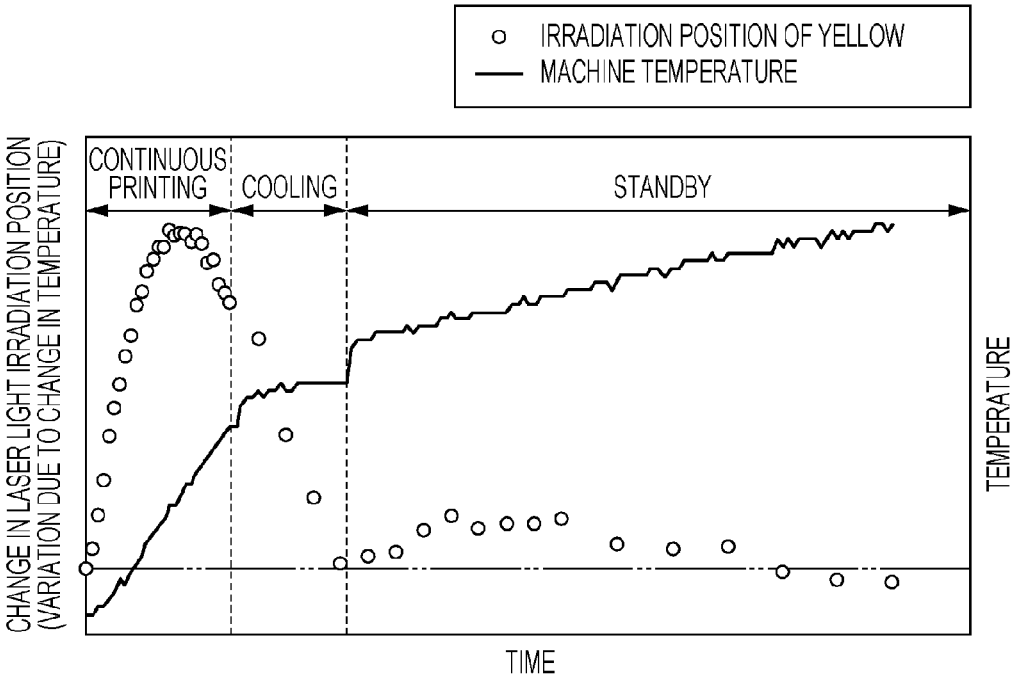
FIG. 6 is a graph illustrating a variation in the laser light irradiation position across multiple operation modes of the image forming apparatus.

Referring back to FIG. 7, the calculation concerning the estimation of the color deviation is performed by the CPU 321 at a predetermined time interval with a timer in Step S702. In Step S703, the CPU 321 checks (confirms) the current operation mode m in the image forming apparatus. The CPU 321 applies the values of the corresponding parameters in the parameter table stored in the non-volatile storage device 324 to the algorithm function, Expression (1). For example, as shown in FIG. 6, a case is assumed in which, after the continuous printing (the printing in the print 1 mode) is terminated, the cooling operation in which a cooling fan provided in the image forming apparatus is driven for a predetermined time is performed and, then, the operation mode is moved to the standby mode. In this case, in the parameter table in FIG. 3, the parameters are switched in the following manner. Since the operation mode is set to the "print 1" mode (the operation mode m=4) during the printing, the parameters in an area A in FIG. 3 are applied to the algorithm. In the cooling mode after the printing, the operation mode is set to the "cooling mode" (the operation mode=3) and the parameter in an area B in FIG. 3 are applied to the algorithm. After the operation mode is moved to the standby mode, the parameters in an area C corresponding to the "standby mode" (the operation mode=1) are applied to the algorithm. The algorithm function, Expression (1), inherits the history of the calculation result in the operation mode just before upon switching of the operation mode m to continue the calculation. Accordingly, the variations illustrated in FIGS. 4A, 4B, and 4C can be estimated with the algorithm function, Expression (1).

In Step S704, the CPU 321 applies the parameters corresponding to the operation mode to the algorithm function to perform the calculation. In Step S705, the CPU 321 calculates the amount of color deviation of each color with respect to yellow, which is the reference color, according to Expression (2).

In Step S706, the CPU 321 calculates the difference in the amount of color deviation of magenta, which exhibits the largest amount of color deviation when yellow is used as the reference color, from a reference and stores the result of the calculation in the RAM 323. The reference here means the amount of deviation (MagentaCalc(0)) when the timer starts counting in Step S702 and, thus, is equal to zero. In the image forming apparatus of the first embodiment, the stations of Y, M, C, and K are subjected to the thermal deformation at the same degree (scale) in response to environmental change, such as the detected temperature or humidity. For example, if the amount of deviation of magenta is halved in response to certain environmental change, the amounts of deviation of the other colors are approximately halved. Accordingly, attention is paid to magenta, which exhibits the largest amount of color deviation, that is, which has the highest S/N ratio, and the result concerning magenta is applied to the other colors in the flowchart in FIG. 7. Magenta exhibits the largest amount of color deviation because the image forming apparatus exhibits the thermal deformation behavior described above with reference to FIG. 4B. If the colors make little difference in the amount of color deviation that occurs, the following steps may be performed with attention paid to a color other than the color exhibiting the largest amount of color deviation.

In Step S707, the CPU 321 determines whether the difference in the amount of color deviation from the reference state, stored in Step S706, exceeds a threshold value. Specifically, the CPU 321 determines whether the amount of color deviation exceeding a threshold value currently occurs. The time interval between a state in which no color deviation occurs and the time when the determination in Step S707 is affirmative is generally shorter than the time interval between the state in which no color deviation occurs and the time when the determination in Step S909 is affirmative, described below.

If the CPU 321 determines that the difference in the amount of deviation exceeding the threshold value currently occurs, in Step S708, the CPU 321 stores the current amount of color deviation of each color in the RAM 323. In Step S709, the CPU 321 requests the video controller 200 to perform the calibration. Then, the process goes back to Step S702. The engine control unit (the CPU 321) receives an instruction to perform the calibration from the video controller 200 in response to the request in Step S709 to perform the calibration with formation and detection of the color deviation detection marks, described above with reference to FIG. 8.

If the CPU 321 determines in Step S707 that the difference in the amount of deviation exceeding the threshold value does not occur, in Step S710, the CPU 321 updates the absolute value of the amount of color deviation of each color, calculated in Step S705, and stores the updated absolute value in the RAM 323. The threshold value may be the operation time of the image forming apparatus in a certain operation mode or may be the result of the estimation in Step S706.

In Step S711, the CPU 321 determines whether the accumulated value (accumulated error) of the calculated estimated error of any color exceeds a threshold value. The accumulated value here means a parameter representing the accumulated error in the estimation calculation. For example, the time interval between the state in which no color deviation occurs and the time when the amount of color deviation is estimated or the number of times when the amount of color deviation is estimated may be applied to the accumulated value. Alternatively, the accumulated value of the absolute values of the differences in the amount of color deviation that have been estimated may be used as the accumulated value. Various parameters can be applied to the accumulated value as long as the parameters concern the estimated error. If the determination in Step S711 is affirmative, in Step S712, the CPU 321 stores the current amount of color deviation of each color in the RAM 323. In Step S713, the CPU 321 requests the video controller 200 to perform the calibration. Then, the process goes back to Step S702. Since the determination in Step S707 is made affirmative before moving to the state in which the determination is affirmative in Step S711, Steps S712 and S713 are normally rarely performed.

If the accumulated value of the error does not exceed the threshold value, in Step S714, the CPU 321 calculates the number of lines to be corrected of each color for the appropriate correction of the color deviation from the result of the calculation in Step S705. The number of lines is calculated so that the current estimated value of the amount of the color deviation is cancelled. If the number of lines to be corrected is changed in any station as the result of the calculation (YES in Step S715), in Step S716, the CPU 321 requests the video controller 200 to shift the image data writing timing of the color corresponding the station. However, when yellow is the basic color, the request is submitted for every color other than yellow. For example, when the amount of correction of cyan is changed from +5 lines to +4 lines as the result of the calculation, the CPU 321 requests the video controller 200 to change the amount of correction of cyan to +4 lines. Upon reception of the shift request, the video controller 200 applies the timing shift from the beginning of a printout image of the subsequent page. If the number of lines to be corrected is not changed in any station in Step S715, the process goes back to Step S702. When a print job is not being executed, the timing shift is performed from the first page of the print job. The method of correcting the color deviation is not limited to an electrical method. A mechanical method may be applied as the method of correcting the color deviation.

<Flowchart to Set Amount-Of-Color Deviation Estimating Unit for Correction>

Figure 9:
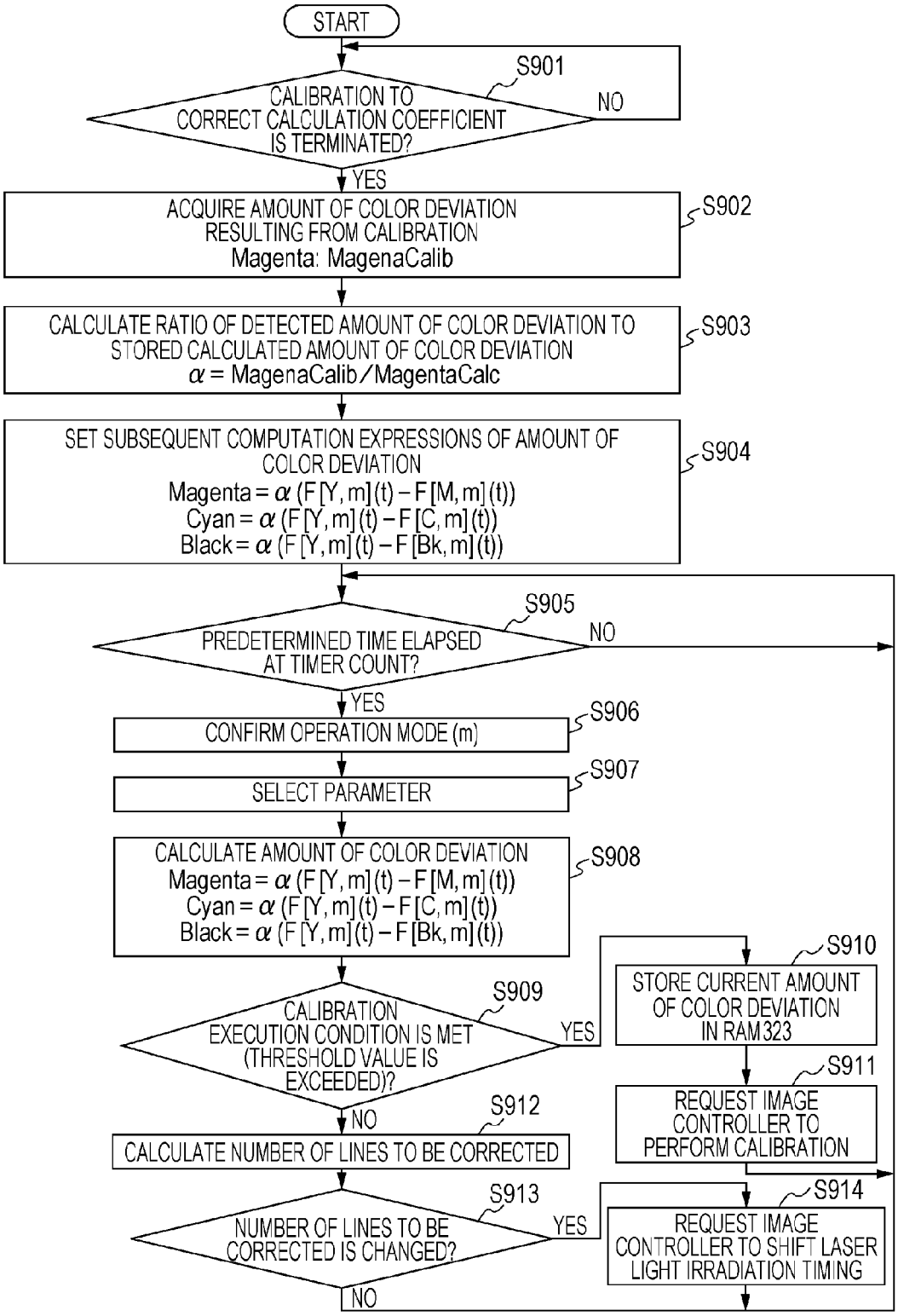
FIG. 9 is a flowchart showing how to set the amount-of-color deviation estimating unit for correction according to the first embodiment.

FIG. 9 is a flowchart showing how to set the amount-of-color deviation estimating unit for correction. Steps S901 to S904 in FIG. 9 are performed to correct the arithmetic expression by the engine control unit in FIG. 2. Referring to FIG. 9, in Step S901, the CPU 321 determines whether the calibration to correct a calculation coefficient in response to Step S709 in FIG. 7 is terminated. If the CPU 321 determines in Step S901 that the calibration is terminated, in Step S902, the CPU 321 acquires the amount of color deviation resulting from the calibration in response to Step S709. In Step S903, the CPU 321 calculates a ratio $\alpha$ between the amount of color deviation that is actually detected (the result of the detection), acquired in Step S902, and the calculated amount of color deviation (the amount of color deviation stored in the RAM 323), acquired in Step S705. In Step S904, the CPU 321 sets the following computation expressions of the amount of color deviation, which are subsequently used. Setting the calculation coefficient ($\alpha$) for the following computation expressions allows the calculated amount of deviation to be close to the amount of deviation that is actually detected to improve the calculation accuracy. The calculation coefficient may be set for the known arithmetic expressions to perform the correction, or the CPU 321 may select an arithmetic expression for which a calculation coefficient close to a desired value is set from multiple arithmetic expressions stored in the non-volatile storage device 324 in advance.

$$\text{Magenta: } \alpha\{F_{[Y,m]}(t)-F_{[M,m]}(t))$$

$$\text{Cyan: } \alpha\{F_{[Y,m]}(t)-F_{[C,m]}(t))$$

$$\text{Black: } \alpha\{F_{[Y,m]}(t)-F_{[Bk,m]}(t))$$

<Flowchart to Estimate Amount of Color Deviation After Setting Amount-Of-Color Deviation Estimating Unit for Correction>

The timing when the calibration is performed after Steps S901 to S904 will now be described. Since Steps S905 to S907 are the same as Step S702 to S704 in FIG. 7, a detailed description thereof is omitted herein.

In Step S908, the CPU 321 calculates the amount of color deviation of each color with respect to yellow, which is the basic color. The calculation of step S908 differs from Step S705 in FIG. 7 (Expression (2)) in that the amount of color deviation of each color is multiplied by the ratio $\alpha$ calculated in step S903.

In Step S909, the CPU 321 determines for each color excluding yellow whether a calibration execution condition is met. Specifically, the CPU 321 determines whether the accumulated value of parameters concerning the estimated error of the color deviation of any color exceeds a threshold value, as in Step S711. The parameters concerning the estimated error of the color deviation are described above in Step S711. The parameters used as the threshold value for the determination in Step S707 and S1107 are set separately from the parameter used as the threshold value for the determination in Step S909. Accordingly, in some cases, one of the parameters used in the determination in Step S909 and Step S707 is called a first threshold value and the other thereof is called a second threshold value in order to distinguish the parameter used in the determination in Step S909 from the parameter used in the determination in Step S707.

If the determination in Step S909 is affirmative, in Steps S910 and S911, the same steps as in Steps S708 and S709 in FIG. 7 are performed. Then, the process goes back to Step S905. The timing when the determination in Step S909 is affirmative is different from the timing when the determinations in Steps S707 and S1107 are affirmative. If the CPU 321 determines in Step S909 that the calibration execution condition is not met, in Steps S912 to S914, the CPU 321 performs the same steps as in Steps S714 to S716 in FIG. 7 on the basis of the result of the calculation in Step S908.

As described above, the CPU 321 can perform the flowcharts in FIG. 7 and FIG. 9 to increase the ratio of the error in the detected value of the amount of color deviation, thereby eliminating the difficulty in accurately finding the relationship between the actual amount of color deviation and the estimated amount of color deviation. Accordingly, it is possible to more accurately find the relationship between the actual amount of color deviation and the estimated amount of color deviation, thus facilitating the improvement in accuracy in the calculation to estimate the amount of color deviation.

<Result of Correction of Color Deviation>

Figure 10A:
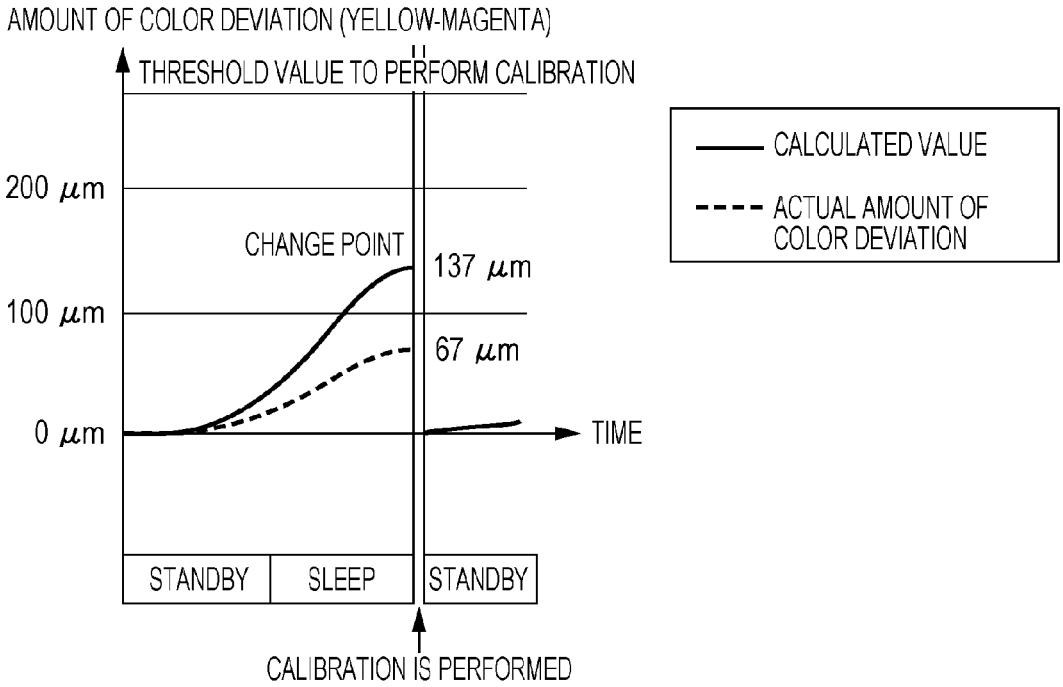
FIG. 10A is a graph illustrating an estimated color deviation and an actual color deviation between yellow and magenta according to the first embodiment and FIG. 10B is a graph illustrating timing when calibration is performed.
Figure 10B:
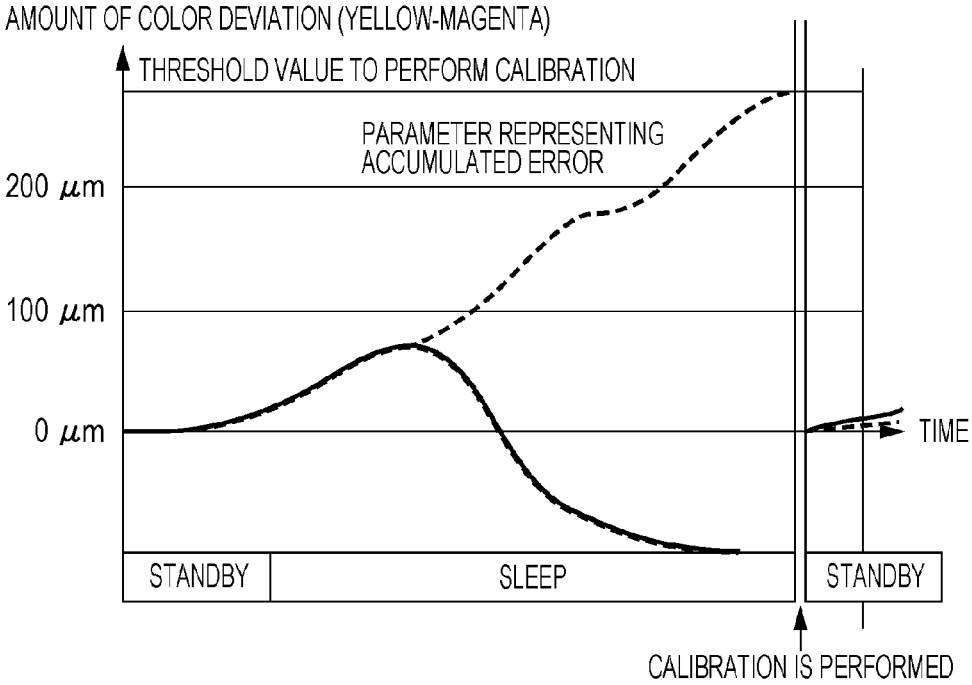

Exemplary results of actual application of the timing of calibration correction based on the present invention are illustrated in FIGS. 10A and 10B. FIG. 10A illustrates an example of the timing when the calibration is performed if the determination of the difference in the amount of color deviation between yellow and magenta in Step S707 in FIG. 7 is affirmative.

In the example in FIG. 10A, the measured value of the color deviation between yellow and magenta when the calibration is performed was 67 μm and the calculated value of the color deviation immediately before the calibration was 137 μm. In this case, the CPU 321 stores a value resulting from multiplying the amount of deviation by 67/137 (correction parameter (α)) in the RAM 323 and feeds back the value to the subsequent estimation of the amount of deviation (corrects the amount of deviation).

At the subsequent calibration timing, the calculation to estimate the amount of color deviation reflecting the correction parameter α is performed, as illustrated in FIG. 10B. If the accumulated value of the estimated error of the amount of color deviation exceeds the threshold value, the CPU 321 determines that the reliability of the estimation result is reduced and performs the calibration. The accumulated value which is compared with the threshold value is the parameter representing the accumulated error in the estimation calculation, as described above. Another parameter may be used as long as it represents that the accumulated error in the estimation calculation is increased. For example, the degree of variation in temperature may be used as the parameter, instead of the parameter described above. Alternatively, the number of times of the estimation calculation or the time required to perform the estimation calculation may be used as the parameter. The above embodiment can be realized to increase the time before the next calibration is performed, as apparent from Fiqs. 10A and 10B, and to suppress the consumption of consumable parts.

<Modification of First Embodiment>

Figure 16A:
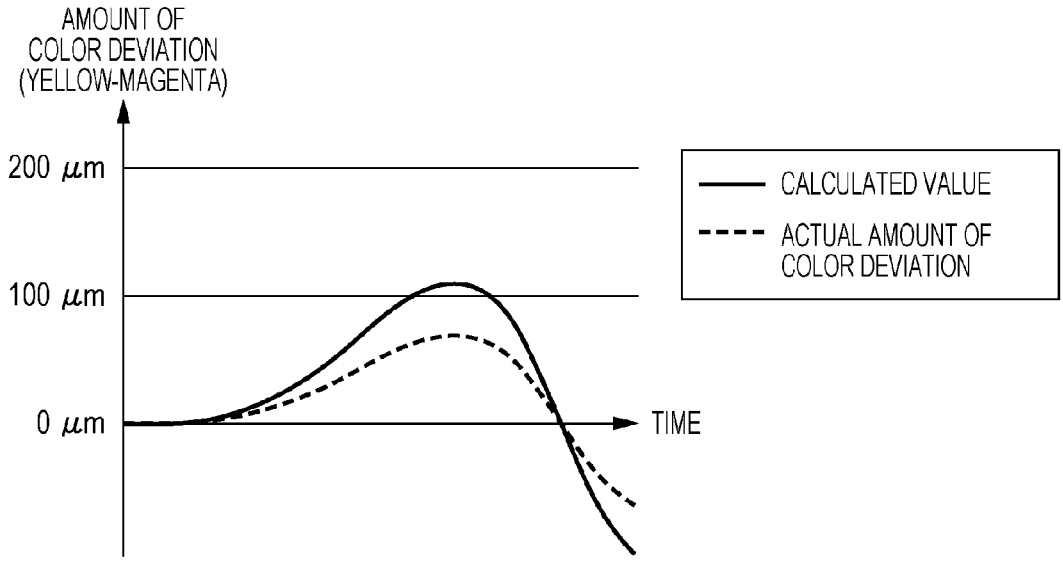
FIGS. 16A and 16B include graphs for describing problems.
Figure 16B:
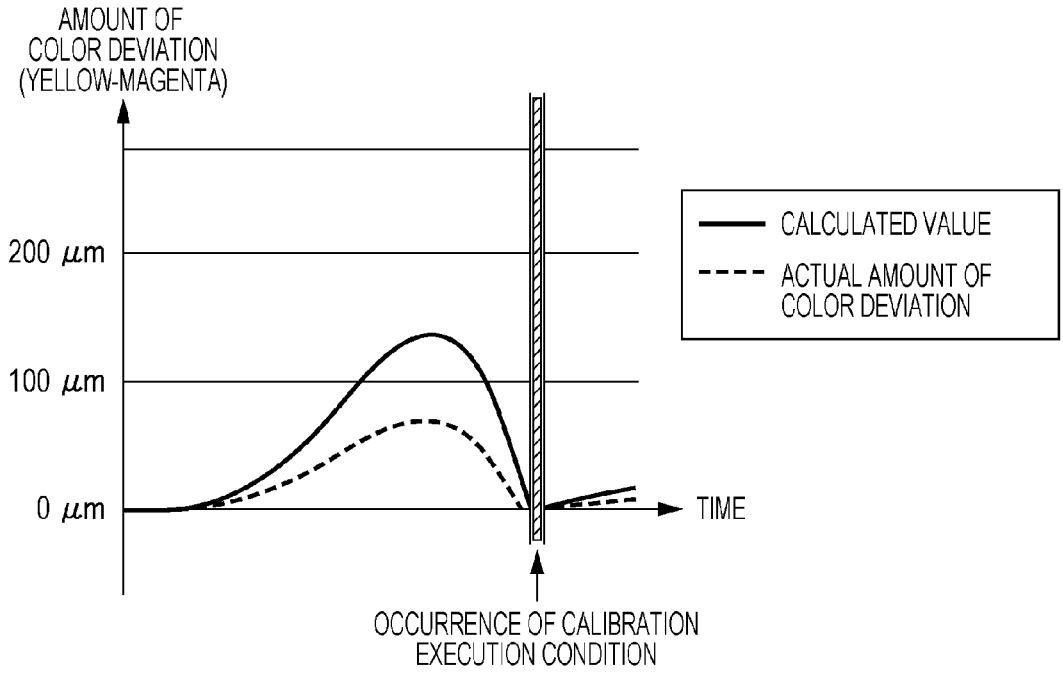

The case in which the determination by the CPU 321 in Step S707 is affirmative if MagentaDiff(t) exceeds the threshold value is described above. However, the base of the determination is not limited to the above one. For example, the determination in Step 707 may be affirmative if a convex peak is detected in the relative amount of color deviation illustrated in FIGS. 16A and 16B. In this case, the CPU 321 detects inversion of the sign of the result of the calculation in Step S706. However, it is made a condition in this case that the amount of color deviation corresponding to the detected peak exceeds the threshold value used in Step S707. In other words, the CPU 321 practically determines in Step S707 that the threshold value is exceeded on the basis of the fact that the variation in the calculated amount of deviation reaches the peak. Detection of the inversion of the sign of the result of the calculation in Step S706 allows a concave peak (minimum point), opposite to the one in FIGS. 16A and 16B, to be detected. Similar effects can be achieved also if the CPU 321 is caused to determine a state near a peak, instead of an accurate peak state.

Although the CPU 321 performs the calculation using the mathematical expressions to estimate the amount of color deviation in the above description, the CPU 321 may use a table, instead of the mathematical expressions, to perform the calculation. The table receives parameters including a station, an operation mode, and an elapsed time to output the amount of color deviation. When the table is used, the output value in response to the input parameters is set for the correction, instead of setting the calculation coefficient in the above manner.

Second Embodiment

It is assumed in the first embodiment that the same scale of variation in the amount of color deviation in response to environmental change (the amount of color deviation caused by the thermal effect in the apparatus) (the same degree of variation in the color deviation) is applied to each color. In contrast, a case will be described in a second embodiment of the present invention, in which different scales of variation in the amount of color deviation in response to environmental change occur in different colors.

<Flowchart Concerning Determination of Timing when Amount-Of-Color Deviation Estimating Unit is Set for Correction>

Figure 11:
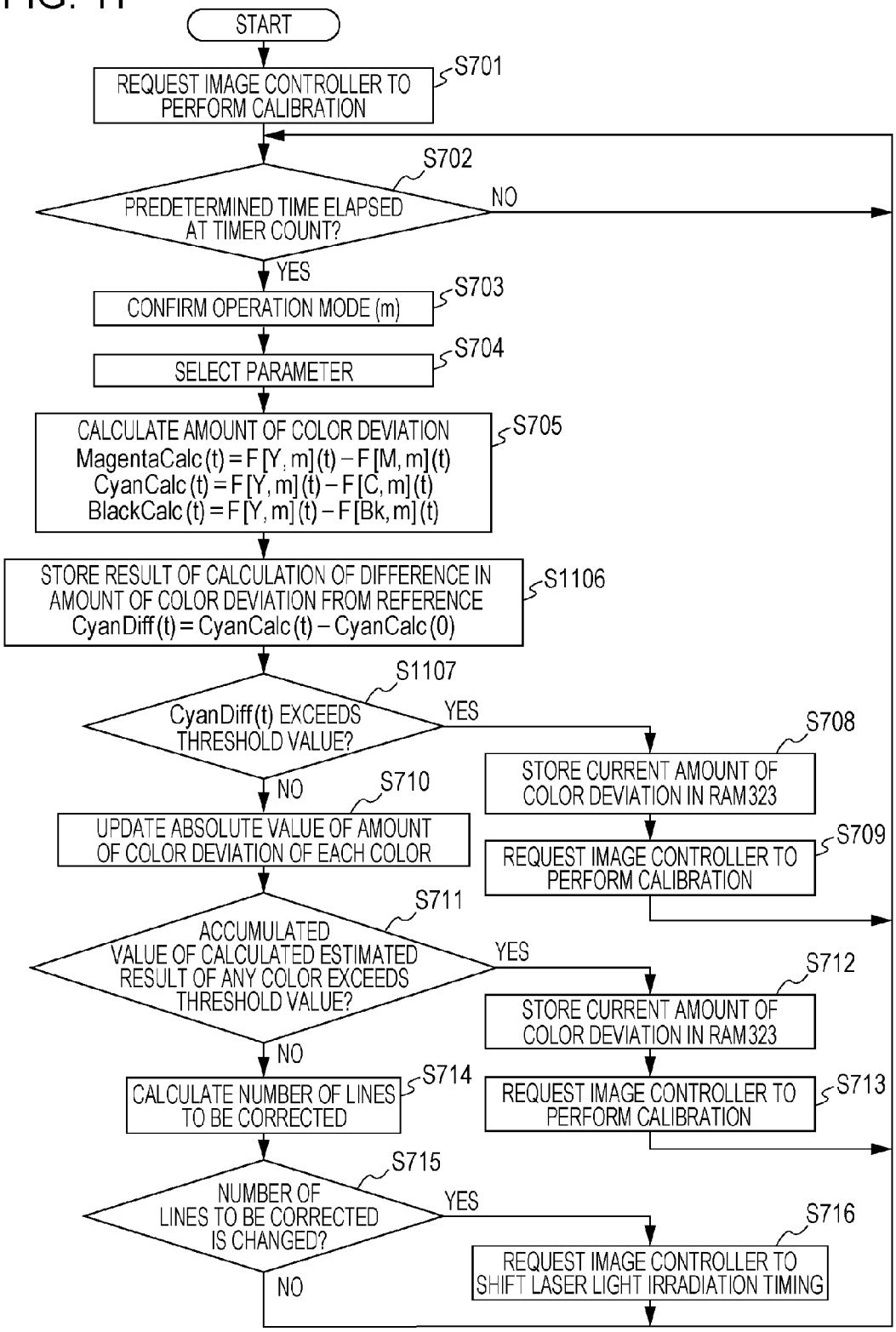
FIG. 11 is a flowchart concerning determination of timing when the amount-of-color deviation estimating unit is set for correction.

FIG. 11 is a flowchart to determine the timing when an arithmetic expression is corrected in the second embodiment. The same step numbers are used in FIG. 11 to identify the steps in which the same processing as in FIG. 7 is performed. The difference from the flowchart in FIG. 7 will now be mainly described.

In Step S1106, the CPU 321 calculates the difference in the amount of color deviation of cyan from a reference and stores information about the result of the calculation in the RAM 323. Attention is paid to cyan because cyan has the smallest amount of color deviation, that is, the lowest S/N ratio, as apparent from FIG. 4B. In other words, attention is paid to cyan in order to detect a sufficient amount of color deviation for the color that is likely to be affected by the detection error. In Step S1107, the CPU 321 determines whether the difference in the amount of color deviation of cyan from the reference state, stored in Step S1106, exceeds a threshold value. Specifically, the CPU 321 determines whether the amount of color deviation exceeding a threshold value currently occurs. Since the remaining steps are the same as the ones described above with reference to FIG. 7, a detailed description thereof is omitted herein.

<Flowchart to Set Amount-Of-Color Deviation Estimating Unit for Correction>

Figure 2:
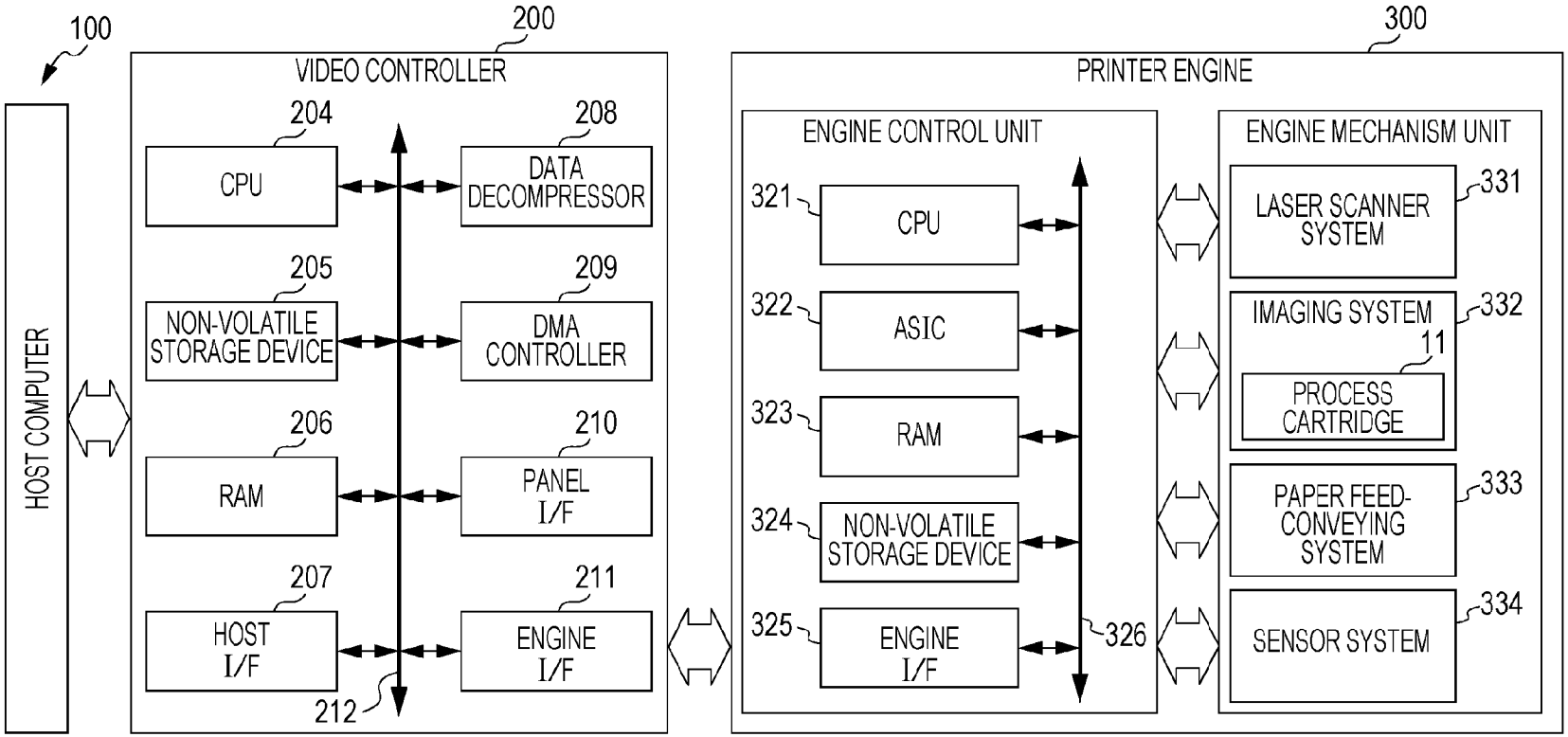
FIG. 2 is a block diagram illustrating a hardware configuration of a printer.
Figure 12:
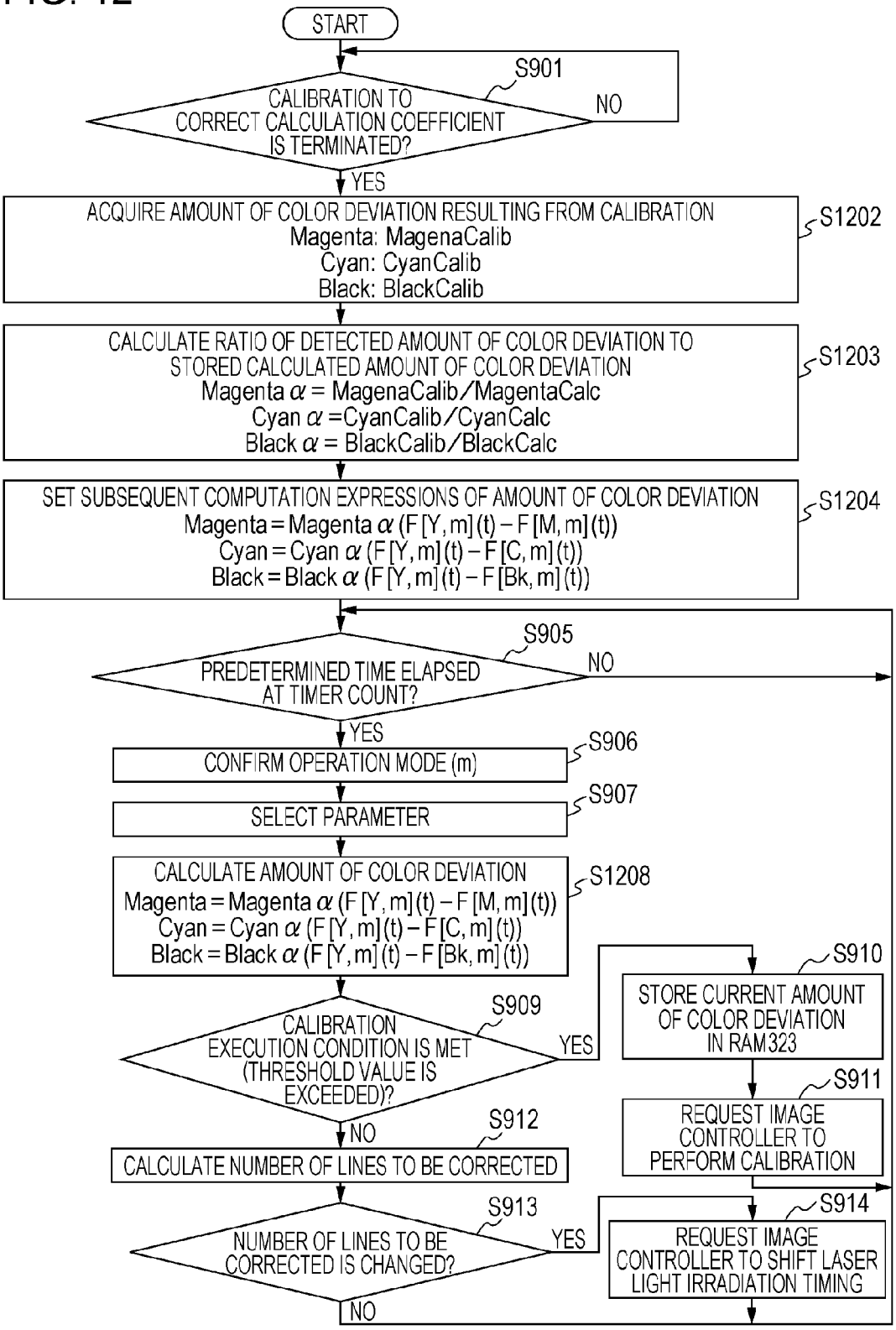
FIG. 12 is a flowchart showing how to set the amount-of-color deviation estimating unit for correction.

In Steps S901 and S1202 to S1204 in a flowchart in FIG. 12, an arithmetic expression is corrected by the engine control unit in FIG. 2. The difference from the flowchart in FIG. 9 will now be mainly described. In Step S1202, the CPU 321 acquires the amount of color deviation resulting from the calibration by the formation and detection of the color deviation detection marks in response to Step S709. Although the CPU 321 acquires the amount of color deviation of only magenta in Step S902 in FIG. 9, the CPU 321 acquires the amounts of color deviation of magenta, cyan, and black in Step S1202 because different degrees of variation in the amount of color deviation in response to environmental change occur in different colors.

In Step S1203, the CPU 321 calculates ratios α between the results of calibration (the amounts of deviation from the reference), acquired in Step S1202, and the calculated amounts of color deviation acquired in Step S705 for cyan, magenta, and black. In Step S1204, the CPU 321 sets the following computation expressions of the amount of color deviation for cyan, magenta, and black, which are subsequently used:

$$\text{Magenta: Magenta } \alpha\{F_{[Y,m]}(t)-F_{[M,m]}(t))$$

$$\text{Cyan: Cyan } \alpha\{F_{[Y,m]}(t)-F_{[C,m]}(t))$$

$$\text{Black: Black } \alpha\{F_{[Y,m]}(t)-F_{[Bk,m]}(t))$$

In Step S1208, calculation to estimate the amount of color deviation is performed on the basis of the computation expression updated by the CPU 321. The same step numbers are used in FIG. 12 to identify the steps in which the same processing as in FIG. 9 is performed. A detailed description thereof is omitted herein.

As described above, according to the second embodiment, effects similar to the ones in the first embodiment can be achieved even when different scales (degrees) of variation in the amount of color deviation in response to environmental change occur in different colors. As a modification, the determination in Step S1107 may be made affirmative on the basis of the detection of a concave or convex or peak, as in the first embodiment.

Third Embodiment

Figure 13A:
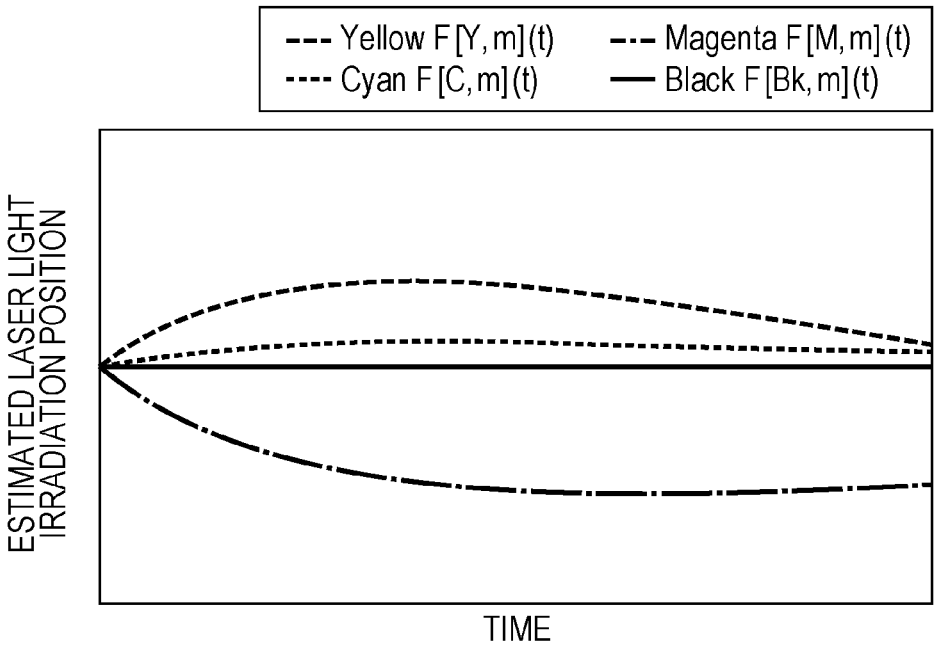
FIG. 13A is a graph illustrating a result of calculation by an estimation algorithm according to a third embodiment and FIG. 13B is a graph resulting from conversion of a result of estimation into color deviation (yellow based) according to the third embodiment.
Figure 13B:
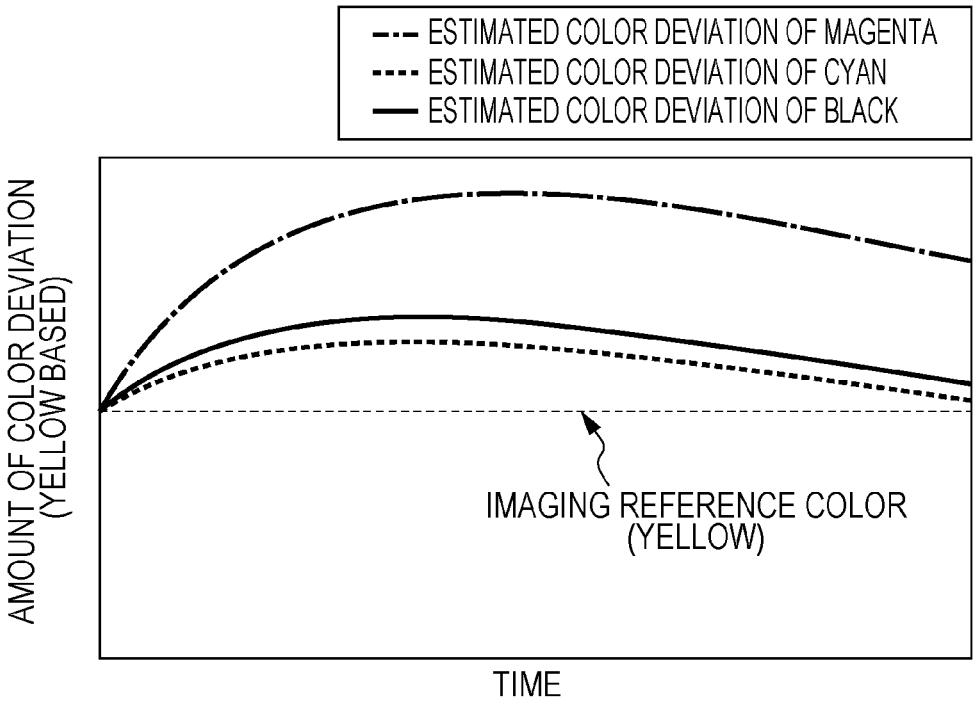
Figure 14A:
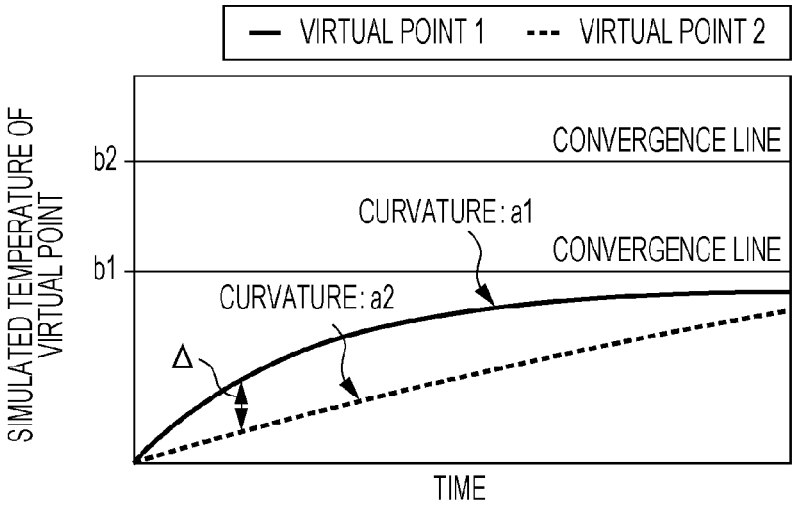
FIGS. 14A, 14B and 14C include graphs illustrating the basic structure of the algorithm according to the third embodiment.
Figure 14B:
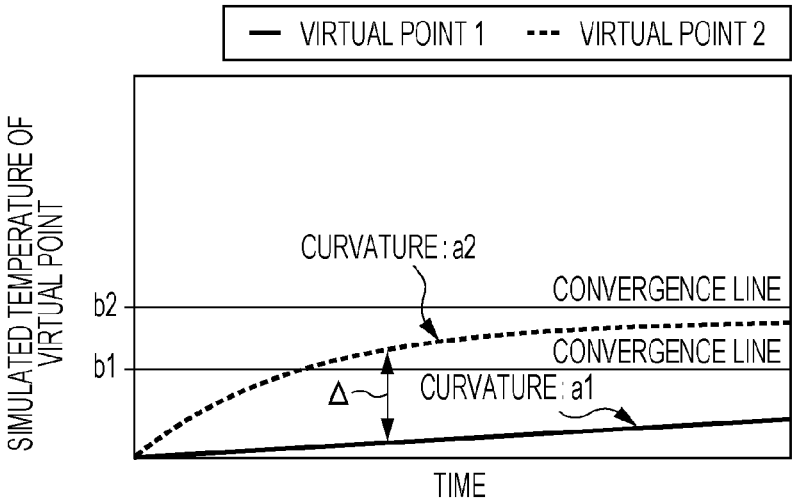
Figure 14C:
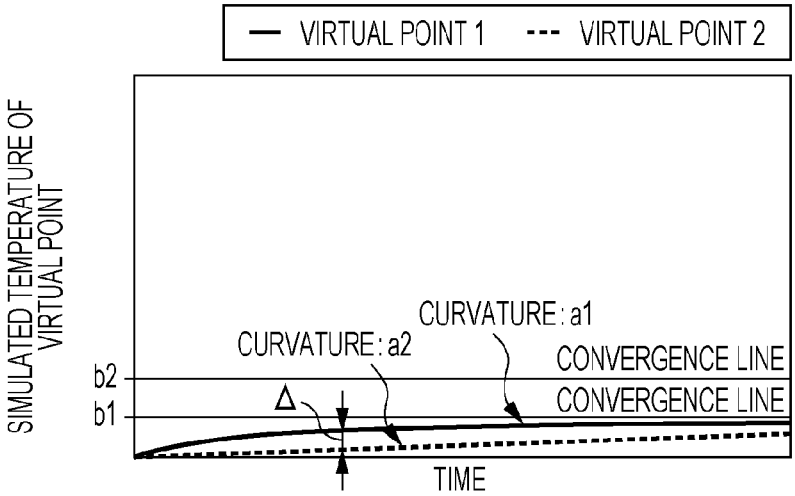

The case in which the peaks in the positional shift of each color and in the variation in the color deviation between the colors substantially synchronously occur is described in the first and second embodiments. However, the present invention is also applicable to an image forming apparatus having, for example, the characteristics of the variation in laser light irradiation position illustrated in FIG. 13A. FIG. 13B is a graph resulting from conversion of the result of estimation of the variation in the laser light irradiation position illustrated in FIG. 13A into the color deviation based on yellow. The positions of peaks of the different colors are not synchronized with each other in FIG. 13A and FIG. 13B, compared with FIG. 4B and FIG. 15. FIGS. 14A, 14B, and 14C include graphs illustrating the results of estimation of how the virtual points (the first thermal effect and the second thermal effect) for yellow, magenta, and cyan in FIG. 13A are varied with temperature. As in the graph in FIG. 4C, the CPU 321 can estimate the variation in the laser light irradiation position (the variation in the image forming position) on the basis of Δ in the graphs.

If the same scale of variation in the amount of color deviation in response to environmental change is applied to each color, the flowcharts in FIG. 7 and FIG. 9 are performed. If different scales of variation in the amount of color deviation in response to environmental change occur in different colors, the flowcharts in FIG. 11 and FIG. 12 are performed. This allows effects similar to the ones in the first and second embodiments to be achieved even in the image forming apparatus having the characteristics of the variation in the laser light irradiation position (the characteristics of the variation in the image forming position) illustrated in FIG. 13A.

Fourth Embodiment

Figure 15:
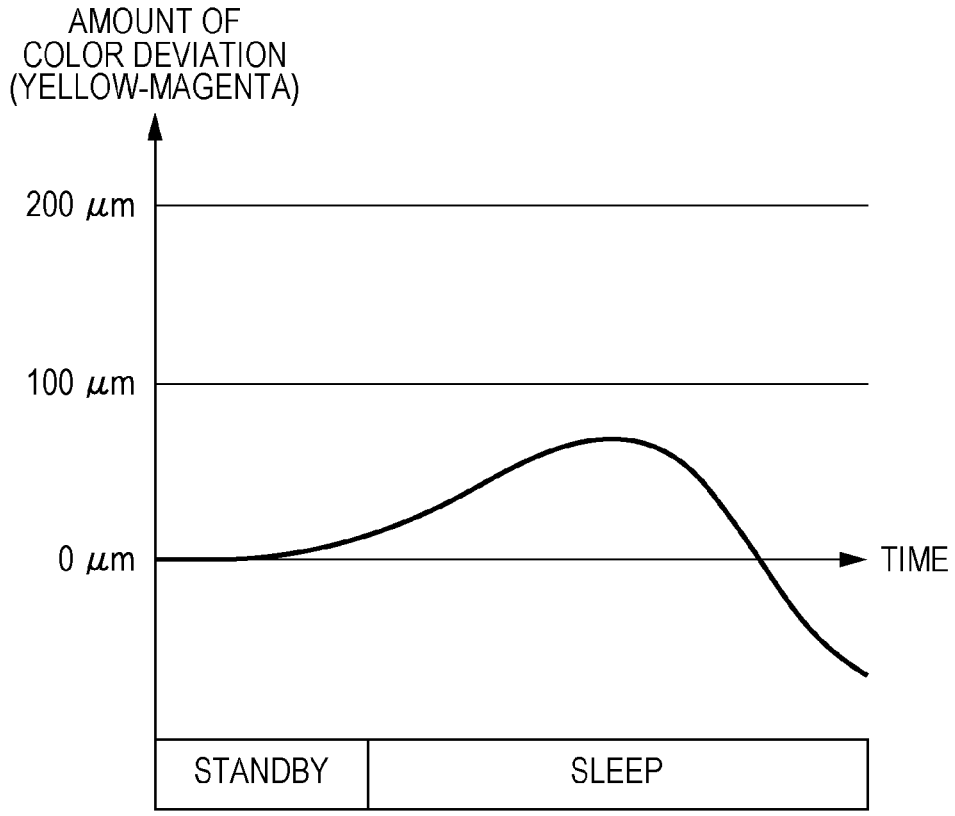
FIG. 15 is a graph illustrating an occurrence of color deviation when the apparatus moves to a sleep mode.

FIG. 15 is a graph illustrating the amount of color deviation between yellow and magenta when the engine moves from the standby state to the sleep mode. The horizontal axis represents time and the vertical axis represents the amount of color deviation between yellow and magenta.

As illustrated in FIG. 15, the color deviation temporarily increases when the operation mode is moved to the sleep mode. This is because, when the apparatus enters the sleep mode, the cooling fan stops and, thus, the air flow in the apparatus is lost. When the air flow in the apparatus is lost, the remaining heat in the fixing unit 25 affects the scanner area and, particularly, a larger amount of deviation occurs in yellow arranged near the fixing unit 25. As for the other colors, the remaining heat has little effect on cyan and black while a slight increase in temperature is caused in magenta. Accordingly, when the operation mode is moved to the sleep mode, the amount of color deviation with respect to the image forming position of yellow is increased, as illustrated in FIG. 15.

In a fourth embodiment of the present invention, when the operation mode is moved to the sleep mode without affirmation, for example, in Step S707 in FIG. 7 in the above background, the CPU 321 increases the threshold value used in the determination in Step S707. This allows the accuracy of the estimation of the color deviation to be evaluated in the state in which the larger amount of color deviation occurs.

As described above, according to the fourth embodiment, the sleep mode can be used to easily increase the S/N ratio and calculate the more accurate correction parameter α in Step S903. In addition, the same applies to Steps S1107 and S1203.

Fifth Embodiment

The time before the determination concerning the amount of color deviation that newly occurs is affirmative in S909 (reaches the threshold value) is described to be generally longer than the time before the determination concerning the amount of color deviation that newly occurs is affirmative in Step S707 or S1107 (reaches the threshold value) in the first to fourth embodiments. However, the opposite case can occur. Specifically, either of the threshold values is not necessarily larger than the remaining threshold value as long as the parameter used as the threshold value in the determination in Step S707 or S1107 is set separately from the parameter used as the threshold value in the determination in Step S909.

For example, the time interval between a state in which the color deviation does not substantially occur and the time when the determination in Step S707 or S1107 is affirmative may be longer than the time interval between the state in which the color deviation does not substantially occur and the time when the determination in Step S909 is affirmative in order to cause a larger amount of deviation in the processing in Step S903 or S1203. In other words, even if the estimation error parameter reaches a value at which the determination in Step S909 is normally affirmative, no color deviation detection mark in FIG. 8 may be created and, after an additional time elapses, the determination by the CPU 321 in Step S707 or S1107 may be made affirmative. It is not necessary to constantly perform the above control method and it is sufficient for the above control method to be performed only once in response to, for example, turning on of the color image forming apparatus.

Particularly, the above control method is effective in a case in which the value targeted for the determination in Step S707 or S1107 continues to increase even after the estimation error parameter reaches a value at which the determination in Step S909 is affirmative and in which it is desirable to more accurately perform the processing in Step 903 or S1203.

According to the present invention, it is possible to more accurately determine the relationship between an actual amount of deviation of an image forming position from a reference and an estimated amount of deviation to facilitate the improvement in the estimation accuracy of the amount of deviation.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of International Patent Application No. PCT/JP2010/051825, filed Feb. 8, 2010, which is hereby incorporated by reference herein in its entirety.

The invention claimed is:

1. An image forming apparatus calculating an amount of deviation of an image forming position from a reference, the amount of deviation being caused by thermal effect in the apparatus, the image forming apparatus comprising:

an estimating unit for estimating the amount of deviation with time;

a mark forming unit for forming a color deviation detection mark;

a detecting unit for detecting reflected light upon irradiation of the formed color deviation detection mark with light;

a control unit for causing the mark forming unit to form the color deviation detection mark and causing the detecting unit to perform detection at a timing when the amount of deviation estimated by the estimating unit is estimated to reach a threshold value; and a setting unit for setting the estimating unit so that an amount of deviation that is estimated becomes close to the amount of deviation that actually occurs based on the amount of deviation detected at the timing and the amount of deviation estimated by the estimating unit, wherein the control unit causes the mark forming unit to form the color deviation detection mark and causes the detecting unit to perform the detection at another timing different from the timing when the amount of deviation reaches the threshold value again after the setting by the setting unit is performed.

2. The image forming apparatus according to claim 1, wherein the another timing occurs subsequently to the timing when the amount of deviation reaches the threshold value again.

3. The image forming apparatus according to claim 1, wherein the threshold value is set as a first threshold value, and the control unit causes the mark forming unit to form the color deviation detection mark and causes the detecting unit to perform the detection when a parameter concerning an accumulated error of the amount of deviation estimated by the estimating unit reaches a second threshold value.

4. The image forming apparatus according to claim 1, wherein determination of whether the estimated amount of deviation reaches the threshold value is based on whether a variation in the amount of deviation reaches a peak state.

5. The image forming apparatus according to claim 1, wherein the threshold value is increased in moving to a sleep mode without forming the color deviation detection mark and detecting the amount of deviation.

6. The image forming apparatus according to claim 1, wherein a color for which the estimating unit estimates the amount of deviation exhibits a largest amount of deviation from the reference at the timing.

7. The image forming apparatus according to claim 1, wherein a color for which the estimating unit estimates the amount of deviation exhibits a smallest amount of deviation from the reference at the timing.

8. The image forming apparatus according to claim 1, wherein the setting unit sets a calculation coefficient in calculation to estimate the amount of deviation by the estimating unit.

9. The image forming apparatus according to claim 1, wherein the estimating unit is configured to estimate the amount of deviation based on an operation mode and an operation time of the image forming apparatus, and wherein the setting unit is configured to calculate a ratio between the detected amount of deviation and the estimated amount of deviation and to set the calculated ratio as a calculation coefficient for the estimating unit.

10. An image forming apparatus calculating an amount of deviation of an image forming position from a reference, the amount of deviation being caused by thermal effect in the apparatus, the image forming apparatus comprising:

an estimating unit for estimating the amount of deviation with time;

a mark forming unit for forming a color deviation detection mark;

a detecting unit for detecting reflected light upon irradiation of the formed color deviation detection mark with light; and a control unit for performing color deviation control to cause the mark forming unit to form the color deviation detection mark and cause the detecting unit to perform the detection if a parameter concerning an accumulated error of the amount of deviation estimated by the estimating unit reaches a first threshold value, wherein the color deviation control is performed at timing when the amount of deviation estimated by the estimating unit is estimated to reach a second threshold value that is set independently of the first threshold value, the image forming apparatus further comprising:

a setting unit for setting the estimating unit so that an amount of deviation that is estimated becomes close to the amount of deviation that actually occurs on the basis of the amount of deviation detected at the timing and the amount of deviation estimated by the estimating unit.

11. The image forming apparatus according to claim 10, wherein the timing when the amount of deviation reaches the second threshold value occurs subsequently to the timing when the amount of deviation reaches the first threshold value again.

12. The image forming apparatus according to claim 10, wherein determination of whether the estimated amount of deviation reaches the first threshold value is based on whether a variation in the amount of deviation reaches a peak state.

13. The image forming apparatus according to claim 10, wherein the second threshold value is increased when the amount of deviation reaches the second threshold value and the image forming apparatus moves to a sleep mode without forming the color deviation detection mark and detecting the amount of deviation.

14. The image forming apparatus according to claim 10, wherein the estimating unit is configured to estimate the amount of deviation based on an operation mode and an operation time of the image forming apparatus, and wherein the setting unit is configured to calculate a ratio between the detected amount of deviation and the estimated amount of deviation and to set the calculated ratio as a calculation coefficient for the estimating unit.

15. An image forming apparatus comprising:

an estimating unit for estimating an amount of deviation of an image forming position from a reference with time;

a mark forming unit for forming a color deviation detection mark;

a detecting unit for detecting reflected light upon irradiation of the formed color deviation detection mark with light;

a control unit for causing the mark forming unit to form the color deviation detection mark and causing the detecting unit to detect the color deviation detection mark at timing when the amount of deviation estimated by the estimating unit is estimated to reach a threshold value; and a setting unit for setting the estimating unit so that the amount of deviation estimated by the estimating unit becomes closer to an amount of deviation that actually occurs based on the amount of deviation obtained from a result of detection by the detecting unit and the amount of deviation estimated by the estimating unit at timing when the amount of deviation is estimated to reach a threshold value.

16. The image forming apparatus according to claim 15, wherein the estimating unit is configured to estimate an amount of deviation resulting from a heat effect in the image forming apparatus.

17. An image forming apparatus comprising:

an estimating unit for estimating an amount of deviation of an image forming position from a reference with time;

a mark forming unit for forming a color deviation detection mark;

a detecting unit for detecting reflected light upon irradiation of the formed color deviation detection mark with light;

a control unit for performing color deviation control to cause the mark forming unit to form the color deviation detection mark and cause the detecting unit to detect the color deviation detection mark if a parameter concerning an accumulated error of the amount of deviation estimated by the estimating unit reaches a first threshold value; and a setting unit for setting the estimating unit so that the amount of deviation estimated by the estimating unit becomes closer to the amount of deviation that actually occurs on the basis of the amount of deviation obtained from a result of detection by the detecting unit and the amount of deviation estimated by the estimating unit at timing when the amount of deviation is estimated to reach a second threshold value.

18. The image forming apparatus according to claim 17, wherein the estimating unit is configured to estimate an amount of deviation resulting from a heat effect in the image forming apparatus.

* * * * *